US009495860B2

(12) United States Patent
Lett

(10) Patent No.: US 9,495,860 B2
(45) Date of Patent: Nov. 15, 2016

(54) FALSE ALARM IDENTIFICATION

(71) Applicant: EchoStar Technologies, LLC, Englewood, CO (US)

(72) Inventor: David B. Lett, Duluth, GA (US)

(73) Assignee: EchoStar Technologies L.L.C., Englewood, CO (US)

( * ) Notice: Subject to any disclaimer, the term of this patent is extended or adjusted under 35 U.S.C. 154(b) by 0 days.

(21) Appl. No.: 14/567,348

(22) Filed: Dec. 11, 2014

(65) Prior Publication Data

US 2015/0161882 A1 Jun. 11, 2015

Related U.S. Application Data

(60) Provisional application No. 61/914,856, filed on Dec. 11, 2013.

(51) Int. Cl.

| | |
|---|---|
| ***G08B 25/08*** | (2006.01) |
| ***G08B 25/00*** | (2006.01) |
| *G08B 13/196* | (2006.01) |

(52) U.S. Cl.

CPC ..... *G08B 25/001* (2013.01); *G08B 13/19682* (2013.01); *G08B 13/19684* (2013.01)

(58) Field of Classification Search

CPC ..... H04N 7/18; H04N 7/173; H04N 7/181; H04N 7/186; H04N 5/00; G08B 13/196; G08B 25/00; G08B 25/001; G08B 25/08; G08B 29/185

USPC ..... 340/500, 506, 539.11, 539.14, 541, 340/628, 632; 348/143, 153; 725/80, 85, 725/133

See application file for complete search history.

(56) References Cited

U.S. PATENT DOCUMENTS

| | | | |
|---|---|---|---|
| 4,386,436 | A | 5/1983 | Kocher et al. |
| 4,581,606 | A | 4/1986 | Mallory |
| 4,728,949 | A | 3/1988 | Platte et al. |
| 4,959,713 | A | 9/1990 | Morotomi et al. |
| 5,400,246 | A | 3/1995 | Wilson et al. |
| 5,770,896 | A | 6/1998 | Nakajima |
| 5,805,442 | A | 9/1998 | Crater et al. |
| 5,822,012 | A | 10/1998 | Jeon et al. |
| 5,970,030 | A | 10/1999 | Dimitri et al. |

(Continued)

FOREIGN PATENT DOCUMENTS

| | | |
|---|---|---|
| CA | 2 267 988 A1 | 4/1998 |
| EP | 2 736 027 A1 | 5/2014 |

(Continued)

OTHER PUBLICATIONS

U.S. Appl. No. 14/470,352, filed Aug. 27, 2014 Non Final Office Action mailed Nov. 20, 2015, 28 pages.

(Continued)

*Primary Examiner* — Hung T Nguyen

(74) *Attorney, Agent, or Firm* — Kilpatrick Townsend & Stockton LLP

(57) ABSTRACT

Methods and systems, such as home automation gateways and television receivers, are disclosed for distinguishing between false alarms and actual events. Aspects include transmitting sensor data, such as a video feed from a closed-circuit video system, to a display to allow a user to confirm whether an alarm event is a false alarm or an actual alarm event. Sensor data is optionally recorded to allow later review of the sensor data.

20 Claims, 9 Drawing Sheets

(56) References Cited

U.S. PATENT DOCUMENTS 6,081,758 A 6/2000 Parvulescu
6,104,334 A 8/2000 Allport
6,182,094 B1 1/2001 Humpleman et al.
6,330,621 B1 12/2001 Bakke et al.
6,405,284 B1 6/2002 Bridge
6,502,166 B1 12/2002 Cassidy
6,529,230 B1 3/2003 Chong
6,553,375 B1 4/2003 Huang et al.
6,662,282 B2 12/2003 Cochran
6,976,187 B2 12/2005 Arnott et al.
6,989,731 B1 1/2006 Kawai et al.
7,088,238 B2 8/2006 Karaoguz et al.
7,143,298 B2 11/2006 Wells et al.
7,234,074 B2 6/2007 Cohn et al.
7,346,917 B2 3/2008 Gatto et al.
7,372,370 B2 5/2008 Stults et al.
7,386,666 B1 6/2008 Beauchamp et al.
7,395,369 B2 7/2008 Sepez et al.
7,395,546 B1 7/2008 Asmussen
7,574,494 B1 8/2009 Mayernick et al.
7,590,703 B2 9/2009 Cashman et al.
7,640,351 B2 12/2009 Reckamp et al.
7,694,005 B2 4/2010 Reckamp et al.
7,739,718 B1 6/2010 Young et al.
7,861,034 B2 12/2010 Yamamoto et al.
7,870,232 B2 1/2011 Reckamp et al.
7,969,318 B2 6/2011 White et al.
8,086,757 B2 12/2011 Chang
8,106,768 B2 1/2012 Neumann
8,156,368 B2 4/2012 Chambliss et al.
8,171,148 B2 5/2012 Lucas et al.
8,180,735 B2 5/2012 Ansari et al.
8,201,261 B2 6/2012 Barfield et al.
8,221,290 B2 7/2012 Vincent et al.
8,289,157 B2 10/2012 Patenaude et al.
8,310,335 B2 11/2012 Sivakkolundhu
8,316,413 B2 11/2012 Crabtree
8,413,204 B2 4/2013 White et al.
8,498,572 B1 7/2013 Schooley et al.
8,516,087 B2 8/2013 Wilson et al.
8,550,368 B2 10/2013 Butler et al.
8,619,136 B2 12/2013 Howarter et al.
8,645,327 B2 2/2014 Falkenburg et al.
8,799,413 B2 8/2014 Taylor et al.
8,898,709 B2 11/2014 Crabtree
8,930,700 B2 1/2015 Wielopolski
8,965,170 B1 2/2015 Benea et al.
9,019,111 B1 4/2015 Sloo et al.
9,049,567 B2 6/2015 Le Guen et al.
2002/0019725 A1 2/2002 Petite
2002/0063633 A1 5/2002 Park
2003/0097452 A1 5/2003 Kim et al.
2003/0126593 A1 7/2003 Mault
2003/0133551 A1 7/2003 Kahn
2003/0140352 A1 7/2003 Kim
2003/0201900 A1 10/2003 Bachinski et al.
2004/0117038 A1 6/2004 Karaoguz et al.
2004/0117843 A1 6/2004 Karaoguz et al.
2004/0121725 A1 6/2004 Matsui
2004/0128034 A1 7/2004 Lenker et al.
2004/0148419 A1 7/2004 Chen et al.
2004/0148632 A1 7/2004 Park et al.
2004/0260407 A1 12/2004 Wimsatt
2004/0266419 A1 12/2004 Arling et al.
2005/0038875 A1 2/2005 Park
2005/0188315 A1 8/2005 Campbell et al.
2005/0264698 A1 12/2005 Eshleman
2005/0289614 A1 12/2005 Baek et al.
2006/0011145 A1 1/2006 Kates
2006/0087428 A1 4/2006 Wolfe et al.
2006/0136968 A1 6/2006 Han et al.
2006/0143679 A1 6/2006 Yamada et al.
2007/0044119 A1 2/2007 Sullivan et al.
2007/0078910 A1 4/2007 Bopardikar
2007/0129220 A1 6/2007 Bardha
2007/0142022 A1 6/2007 Madonna et al.
2007/0146545 A1 6/2007 Iwahashi
2007/0157258 A1 7/2007 Jung et al.
2007/0192486 A1 8/2007 Wilson et al.
2007/0256085 A1 11/2007 Reckamp et al.
2007/0271518 A1 11/2007 Tischer et al.
2008/0021971 A1 1/2008 Halgas
2008/0022322 A1 1/2008 Grannan et al.
2008/0062258 A1 3/2008 Bentkovski et al.
2008/0114963 A1 5/2008 Cannon et al.
2008/0123825 A1 5/2008 Abramson et al.
2008/0140736 A1 6/2008 Jarno
2008/0163330 A1 7/2008 Sparrell
2008/0284905 A1 11/2008 Chuang
2008/0288876 A1 11/2008 Fleming
2008/0297660 A1 12/2008 Shioya
2009/0069038 A1 3/2009 Olague et al.
2009/0146834 A1 6/2009 Huang
2009/0165069 A1 6/2009 Kirchner
2009/0167555 A1 7/2009 Kohanek
2009/0190040 A1 7/2009 Watanabe et al.
2009/0249428 A1* 10/2009 White ..... H04L 12/2809 725/133
2010/0046918 A1 2/2010 Takao et al.
2010/0122284 A1 5/2010 Yoon et al.
2010/0138007 A1 6/2010 Clark et al.
2010/0138858 A1 6/2010 Velazquez et al.
2010/0211546 A1 8/2010 Grohman et al.
2010/0321151 A1 12/2010 Matsuura et al.
2011/0030016 A1* 2/2011 Pino, Jr. ..... H04L 12/2818 725/80
2011/0032423 A1 2/2011 Jing et al.
2011/0093126 A1 4/2011 Toba et al.
2011/0119325 A1 5/2011 Paul et al.
2011/0150432 A1 6/2011 Paul et al.
2011/0187928 A1 8/2011 Crabtree
2011/0187930 A1 8/2011 Crabtree
2011/0187931 A1 8/2011 Kim
2011/0202956 A1 8/2011 Connelly et al.
2011/0270549 A1 11/2011 Jeansonne et al.
2011/0282837 A1 11/2011 Gounares et al.
2011/0283311 A1 11/2011 Luong
2012/0019388 A1 1/2012 Kates et al.
2012/0047532 A1 2/2012 McCarthy
2012/0094696 A1 4/2012 Ahn et al.
2012/0124456 A1 5/2012 Perez et al.
2012/0271670 A1 10/2012 Zaloom
2012/0280802 A1 11/2012 Yoshida et al.
2012/0291068 A1 11/2012 Khushoo et al.
2012/0326835 A1 12/2012 Cockrell et al.
2013/0046800 A1 2/2013 Assi et al.
2013/0053063 A1 2/2013 McSheffrey
2013/0060358 A1 3/2013 Li et al.
2013/0070044 A1 3/2013 Naidoo et al.
2013/0074061 A1 3/2013 Averbuch et al.
2013/0090213 A1 4/2013 Amini et al.
2013/0138757 A1 5/2013 Ferron
2013/0152139 A1 6/2013 Davis et al.
2013/0204408 A1 8/2013 Thiruvengada et al.
2013/0267383 A1 10/2013 Watterson
2013/0300576 A1 11/2013 Sinsuan et al.
2013/0318559 A1 11/2013 Crabtree
2013/0321637 A1 12/2013 Frank et al.
2014/0101465 A1 4/2014 Wang et al.
2014/0168277 A1 6/2014 Ashley et al.
2014/0192197 A1 7/2014 Hanko et al.
2014/0218517 A1 8/2014 Kim et al.
2014/0266669 A1 9/2014 Fadell et al.
2014/0266684 A1 9/2014 Poder et al.
2014/0310075 A1 10/2014 Ricci
2014/0351832 A1 11/2014 Cho et al.
2014/0373074 A1 12/2014 Hwang et al.
2015/0143408 A1 5/2015 Sallas
2015/0156612 A1 6/2015 Vemulapalli
2015/0159401 A1 6/2015 Patrick et al.
2015/0160623 A1 6/2015 Holley
2015/0160634 A1 6/2015 Smith et al.
2015/0160635 A1 6/2015 Schofield et al.
2015/0160636 A1 6/2015 McCarthy et al.

(56) References Cited

U.S. PATENT DOCUMENTS

| | | | |
|---|---|---|---|
| 2015/0160663 | A1 | 6/2015 | McCarthy et al. |
| 2015/0161452 | A1 | 6/2015 | McCarthy et al. |
| 2015/0162006 | A1 | 6/2015 | Kummer |
| 2015/0163411 | A1 | 6/2015 | McCarthy et al. |
| 2015/0163412 | A1 | 6/2015 | Holley et al. |
| 2015/0163535 | A1 | 6/2015 | McCarthy et al. |
| 2015/0172742 | A1 | 6/2015 | Richardson |
| 2015/0309487 | A1 | 10/2015 | Lyman |
| 2016/0063854 | A1 | 3/2016 | Burton et al. |
| 2016/0066046 | A1 | 3/2016 | Mountain |
| 2016/0091471 | A1 | 3/2016 | Benn |
| 2016/0109864 | A1 | 4/2016 | Lonn |
| 2016/0121161 | A1 | 5/2016 | Mountain |
| 2016/0123741 | A1 | 5/2016 | Mountain |
| 2016/0182249 | A1 | 6/2016 | Lea |
| 2016/0191912 | A1 | 6/2016 | Lea et al. |

FOREIGN PATENT DOCUMENTS

| | | | |
|---|---|---|---|
| GB | 2 304 952 | A | 3/1997 |
| WO | 93/20544 | A1 | 10/1993 |
| WO | 2004/068386 | A1 | 8/2004 |
| WO | 2011/095567 | A1 | 8/2011 |
| WO | 2016/034880 | A1 | 3/2016 |
| WO | 2016/066399 | A1 | 5/2016 |
| WO | 2016/066442 | A1 | 5/2016 |

OTHER PUBLICATIONS

U.S. Appl. No. 12/700,310, filed Feb. 4, 2010 Final Office Action mailed Oct. 26, 2015, 19 pages.

Fong A.C.M. et al, "Indoor air quality control for asthma patients using smart home technology," Consumer Electronics (ISCE), 2011 IEEE 15th International Symposium on, IEEE, Jun. 14, 2011, pp. 18-19, XP032007803, DOI: 10.1109/ISCE.2011.5973774, ISBN: 978-1-61284-8433, Abstract and sections 3 and 4.

Shunfeng Cheng et al., "A Wireless Sensor System for Prognostics and Health Management," IEEE Sensors Journal, IEEE Service Center, New York, NY, US, vol. 10, No. 4, Apr. 1, 2010, pp. 856-862, XP011304455, ISSN: 1530-437X, Sections 2 and 3.

International Search Report and Written Opinion for PCT/EP2015/070286 mailed Nov. 5, 2015, all pages.

International Search Report and Written Opinion for PCT/GB2015/052544 mailed Oct. 6, 2015, all pages.

International Search Report and Written Opinion for PCT/GB2015/052457 mailed Nov. 13, 2015, all pages.

Mexican Institute of Industrial Property Notice of Allowance dated Feb. 10, 2014, for Mex. Patent Appln No. MX/a/2012/008882, 1 page.

U.S. Appl. No. 12/700,310, filed Feb. 4, 2010 Non-Final Office Action mailed Mar. 11, 2015, 35 pages.

U.S. Appl. No. 14/107,132, filed Dec. 16, 2013 Non Final Office Action mailed May 27, 2015, 26 pages.

U.S. Appl. No. 14/485,188, filed Sep. 12, 2014, Pre-Interview First Office Action mailed Jul. 29, 2015, 20 pages.

U.S. Appl. No. 14/485,188, filed Sep. 12, 2014, Pre-Interview First Office Action mailed Oct. 1, 2015, 10 pages.

"Acoustic/Ultrasound Ultrasonic Flowmeter Basics," Questex Media Group LLC, accessed on Dec. 16, 2014, 4 pages. Retrieved from http://www.sensorsmag.com/sensors/acousticultrasound/ultrasonic-flowmeter-basics-842.

"AllJoyn Onboarding Service Frameworks," Qualcomm Connected Experiences, Inc., accessed on Jul. 15, 2014, 9 pages. Retrieved from https://www.alljoyn.org.

"App for Samsung Smart TV®," Crestron Electronics, Inc., accessed on Jul. 14, 2014, 3 pages. Retrieved from http://www.crestron.com/products/smart tv television apps/.

"Voice Activated TV using the Amulet Remote for Media Center," AmuletDevices.com, accessed on Jul. 14, 2014, 1 page. Retrieved from http://www.amuletdevices.com/index.php/Features/television.html.

"Do you want to know how to find water leaks? Use a Bravedo Water Alert Flow Monitor to find out!", Bravedo.com, accessed Dec. 16, 2014, 10 pages. Retrieved from http://bravedo.com/.

"Flow Pulse®, Non-invasive clamp-on flow monitor for pipes," Pulsar Process Measurement Ltd, accessed on Dec. 16, 2014, 2 pages.Retrieved from http://www.pulsar-pm.com/product-types/flow/flowpulse.aspx.

"International Building Code Excerpts, Updated with recent code changes that impact electromagnetic locks," Securitron, Assa Abloy, IBC/IFC 2007 Supplement and 2009, "Finally-some relief and clarification", 2 pages.Retrieved from: www.securitron.com/Other/ . . . /New_IBC-1FC_Code_Language.pdf.

"Introduction to Ultrasonic Doppler Flowmeters," OMEGA Engineering inc., accessed on Dec. 16, 2014, 3 pages. Retrieved from http://www.omega.com/prodinfo/ultrasonicflowmeters.html.

Lamonica, M., "CES 2010 Preview: Green comes in many colors," retrieved from CNET.com (http://ces.cnet.com/8301-31045_1-10420381-269.html), Dec. 22, 2009, 2 pages.

Robbins, Gordon, Deputy Chief, "Addison Fire Department Access Control Installation," 2006 International Fire Code, Section 1008.1.3.4, 4 pages.

"Ultrasonic Flow Meters," RS Hydro Ltd, accessed on Dec. 16, 2014, 3 pages. Retrieved from http://www.rshydro.co.uk/ultrasonic-flowmeter.shtml.

Wang et al., "Mixed Sound Event Verification on Wireless Sensor Network for Home Automation," IEEE Transactions on Industrial Informatics, vol. 10, No. 1, Feb. 2014, 10 pages.

International Search Report and Written Opinion for PCT/EP2011/051608 mailed on May 30, 2011, 13 pages.

International Preliminary Report on Patentability for PCT/EP2011/051608 mailed Aug. 16, 2012, 8 pages.

International Search Report and Written Opinion for PCT/US2014/053876 mailed Nov. 26, 2014, 8 pages.

International Search Report and Written Opinion for PCT/US2014/055441 mailed Dec. 4, 2014, 10 pages.

International Search Report and Written Opinion for PCT/US2014/055476 mailed Dec. 30, 2014, 10 pages.

Mexican Institute of Industrial Property Office Action dated Nov. 1, 2013, for Mex. Patent Appln No. MX/a/2012/008882 is not translated into English, 3 pages.

U.S. Appl. No. 12/700,310, filed Feb. 4, 2010, Office Action mailed May 4, 2012, 15 pages.

U.S. Appl. No. 12/700,310, filed Feb. 4, 2010, Final Office Action mailed Oct. 10, 2012, 16 pages.

U.S. Appl. No. 12/700,310, filed Feb. 4, 2010 Non-Final Office Action mailed Apr. 1, 2013, 16 pages.

U.S. Appl. No. 12/700,310, filed Feb. 4, 2010 Non-Final Office Action mailed Oct. 15, 2013, 15 pages.

U.S. Appl. No. 12/700,310, filed Feb. 4, 2010 Final Office Action mailed Feb. 28, 2014, 17 pages.

U.S. Appl. No. 12/700,310, filed Feb. 4, 2010 Non-Final Office Action mailed Aug. 14, 2014, 18 pages.

U.S. Appl. No. 12/700,408, filed Feb. 4, 2010, Notice of Allowance mailed Jul. 28, 2012, 8 pages.

U.S. Appl. No. 13/680,934, filed Nov. 19, 2012,Non-Final Office Action mailed Oct. 2, 2013, 7 pages.

U.S. Appl. No. 13/680,934, filed Nov. 19, 2012,Final Office Action mailed Feb. 10, 2014, 13 pages.

U.S. Appl. No. 13/680,934, filed Nov. 19, 2012,Notice of Allowance mailed Apr. 30, 2014, 9 pages.

U.S. Appl. No. 13/680,934, filed Nov. 19, 2012, Notice of Allowance mailed Jul. 25, 2014, 12 pages.

International Search Report and Written Opinion for PCT/EP2015/073299 mailed Jan. 4, 2016, 12 pages.

International Search Report and Written Opinion for PCT/EP2015/073936 mailed Feb. 4, 2016, all pages.

U.S. Appl. No. 14/107,132, filed Dec. 16, 2013, Final Rejection mailed Dec. 16, 2015, 32 pages.

U.S. Appl. No. 14/485,188, filed Sep. 12, 2014, Final Rejection mailed Feb. 23, 2016, 22 pages.

U.S. Appl. No. 14/470,352, filed Aug. 27, 2014 Final Office Action mailed Mar. 17, 2016, all pages.

(56) References Cited

OTHER PUBLICATIONS

U.S. Appl. No. 14/567,765, filed Dec. 11, 2014, Preinterview first office action mailed Apr. 8, 2016, 30 pages.
U.S. Appl. No. 14/577,717, filed Dec. 19, 2014, Preinterview first office action mailed Apr. 4, 2016, 29 pages.
U.S. Appl. No. 14/584,075, filed Dec. 29, 2014, Non-Final Rejection mailed Apr. 1, 2016, 40 pages.
International Preliminary Report on Patentability for PCT/US2014/053876 issued Jun. 14, 2016, 7 pages.
International Preliminary Report on Patentability for PCT/US2014/055441 issued Jun. 14, 2016, 8 pages.
International Search Report and Written Opinion for PCT/US2016/028126 mailed Jun. 3, 2016, all pages.
International Preliminary Report on Patentability for PCT/US2014/055476 issued Jun. 14, 2016, 9 pages.
U.S. Appl. No. 12/700,310, filed Feb. 4, 2010 Non-Final Office Action mailed Jun. 16, 2016, 30 pages.
U.S. Appl. No. 14/528,739, filed Oct. 30, 2014 Notice of Allowance mailed Jun. 23, 2016, 34 pages.
U.S. Appl. No. 14/485,188, filed Sep. 12, 2014, Non-Final Rejection mailed Jun. 17, 2016, 29 pages.
U.S. Appl. No. 14/710,331, filed May 12, 2015, Non-Final Rejection mailed May 20, 2016, 42 pages.

* cited by examiner

210

FALSE ALARM IDENTIFICATION

CROSS-REFERENCE TO RELATED APPLICATION

This application claims the benefit of U.S. Provisional Patent Application Ser. No. 61/914,856, filed 11 Dec. 2013 and is related to U.S. Nonprovisional patent application Ser. No. 14/485,188, filed 12 Sep. 2014, each of which is hereby incorporated by reference in its entirety.

BACKGROUND

Home automation systems are becoming increasingly prevalent, the same of which may incorporate multiple "smart" devices that allow end-users to control and/or view status information for those devices. Systems and methods are contemplated herein to provide such users flexibility and convenience with respect to controlling and/or viewing status information for those and other devices incorporated into their home automation system.

SUMMARY

Described herein are devices, methods, systems and computer program products, for example, useful for minimizing or eliminating false alarm events that generate a security or emergency service response. The disclosed devices, methods, systems and computer program products enable users to make determinations of whether a possible alarm event is an actual alarm event, such an alarm event that would warrant a security or emergency personnel response, or a false alarm event, such as an alarm event that would warrant no response.

For example, users can indicate that a security or emergency response is required for an event like a life threatening emergency, a burglary, fire, destruction of property, etc., by reviewing sensor data from one or more sensors associated with a home automation system. Similarly, users can indicate that no security or emergency response is required for an event like a malfunctioning sensor, an inadvertently triggered sensor, or other non-emergency events.

In a first aspect, provided are methods, such as methods for identifying false alarm events. In an embodiment, a specific method embodiment of this aspect comprises receiving, for example at a computing device comprising one or more processors, such as a television receiver or home automation gateway, a signal from one or more sensors indicating a possible alarm event; receiving sensor data from the one or more sensors; transmitting the sensor data; transmitting a request for user input to confirm the possible alarm event; and detecting user input specifying that the possible alarm event is a false alarm event or an actual alarm event. Optionally, methods of this aspect further comprise storing the sensor data to persistent memory. In an exemplary embodiment, receiving the sensor data at a presentation device generates a display of the sensor data, for example to allow a user to view or otherwise analyze the sensor data. In various embodiments, the presentation device is a mobile phone, a smartphone, a smartwatch, a tablet, an e-reader, a personal digital assistant, a personal computer, a laptop computer, a television, a monitor, a car computer or stereo system, a heads up display, a head mounted display device, and the like.

In various embodiments, the possible alarm event is a security related event, a health related event or a safety related event. Optionally, the possible alarm event is an event that warrants or results in contacting emergency or security authorities if the possible alarm event is an actual alarm event. Non-limiting examples of alarm events include life threatening emergencies, fire, burglary, destruction of property, vandalism and the like. Optionally, input to confirm the possible alarm event includes input specifying whether to make a call to emergency or security authorities. Optionally, input to confirm the possible alarm event includes input specifying whether to record the sensor data, such as by storing the data to persistent memory. Optionally, input to confirm the possible alarm event includes input specifying whether to send an alert to another user.

In certain embodiments, the detected user input specifies that the possible alarm event is a false alarm event. Optionally, methods of this aspect further include transmitting a request for user input to ignore future alarm events generated based on identical or similar sensor data or sensor data matching a profile that is determined to be associated with false alarm events. Such a configuration may be useful for minimizing false alarm events that are generated during known abnormal conditions. For example, some security systems may indicate a possible alarm event at a specific time of day or under specific conditions, such as when a motion sensor or camera is in direct sunlight or receives sunlight at a specific angle for a specific period of time. In other examples, a security system may be triggered by motion associated with the startup or shutdown of a heating or air conditioning system, such as a forced air system that may result in movements to curtains or drapes at start up or shut down. Other false alarm configurations are possible and methods of this aspect may include training algorithms to allow a user to generate a known false alarm event to establish a false alarm sensor data profile to allow later automatic recognition of similar.

In certain embodiments, the detected user input specifies that the possible alarm event is an actual alarm event. Optionally, methods of this aspect further include making contact with emergency or security authorities, such as by dialing a telephone number, such as 9-1-1. In embodiments, upon receiving user input indicating that the possible alarm event is an actual alarm event, a method of this aspect includes controlling a telephone system to dial an emergency telephone number. For example, an emergency telephone number may be a number associated with a home security system monitoring service, a police dispatch number, a fire rescue hotline, an ambulance rescue hotline, 9-1-1, etc. In a specific embodiment, the method further includes facilitating the making of a connection between a user and a local emergency telephone number. Such a configuration may be advantageous for allowing a user at a remote location from a home automation system to connect local authorities nearby the home automation system.

Similar to the above description relating to generation of a false alarm sensor data profile, simulated actual alarm event profiles can be user generated for automatic recognition of actual alarm events. In embodiments, methods of this aspect include transmitting a notification of the possible alarm event that identifies the possible alarm event as matching a simulated actual alarm event profile. In this way, user involvement is still required to confirm that a possible alarm event is an actual alarm event, even though In some embodiments, the sensor data includes video or audio from a closed circuit camera system, such as a camera system connected to a private network. Optionally, a method embodiment further comprises generating a live video feed acquired by the closed-circuit camera system. Optionally, a method embodiments further comprises generating a video feed acquired by the closed-circuit camera system over a predetermined time period before or after the possible alarm event.

For example, in exemplary embodiments, the sensor data includes one or more of fire alarm system data and security system data. These and other types of sensor data are useful with various aspects of the invention. For example, useful sensor data includes, but is not limited to, sensor data from sensors associated with a home automation system.

In embodiments, a method of this aspect further comprises transmitting a notification of the signal, wherein receiving the notification at a presentation device generates a display of the notification. In one embodiment, the notification includes the request for user input. Optionally a method of this aspect further comprises transmitting a notification of user input received specifying that the possible alarm event is a false alarm event or an actual alarm event, such as for purposes of informing other users and/or devices that user input has been received.

Optionally, the computing device includes a network connection and/or network hardware, such as a network interface card or wireless networking components. Optionally, the computing device is connected to a network. In some embodiments, receiving sensor data from the one or more sensors includes receiving sensor data over the network. In some embodiments, transmitting the sensor data includes transmitting the sensor data over the network. In some embodiments, transmitting a request for user input includes transmitting the request for user input over the network. In some embodiments, detecting user input includes receiving user input over the network.

In some embodiments, the sensor data is transmitted over a public network, such as the Internet. Such a configuration advantageously allows a remote user to receive sensor data from the computing device, such as at a mobile device, like a smartphone, tablet or PC. In this way, users do not have to be present at the location of the computing device and can be notified of a possible alarm event at any location where a connection to the public network can be made. In one embodiment, such a configuration allows a user to confirm a false alarm at a residence from a remote location, such as an office or a public venue.

In another aspect provided are devices, such as a television receiver or a home automation gateway. In a specific embodiment, a device of this aspect comprises one or more processors; and a non-transitory computer readable memory element communicatively coupled with and readable by the one or more processors and having stored therein processor-readable instructions that, when executed by the one or more processors, cause the one or more processor to perform one or more of the methods disclosed herein. For example, in an exemplary embodiment, the processor-readable instructions, when executed by the one or more processors, cause the one or more processors to receive a signal from one or more sensors indicating a possible alarm event; receive sensor data from the one or more sensors; transmit the sensor data; transmit a request for user input to confirm the possible alarm event; and detect user input specifying that the possible alarm event is a false alarm event or an actual alarm event. For example, in one embodiment when the sensor data is received at a presentation device the presentation device generates a display of the sensor data. In various embodiments, the presentation device is a mobile phone, a smartphone, a smartwatch, a tablet, an e-reader, a personal digital assistant, a personal computer, a laptop computer, a television, a monitor, a car computer or stereo system, a heads up display, a head mounted display device, and the like.

In embodiments, a device embodiment of this aspect further comprises an audio-video input connection and/or an audio-video output connection. Optionally, the processor-readable instructions that cause one or more processors to transmit the sensor data cause the one or more processors to overlay the sensor data on audio-video signals received at the audio-video input connection to generate an overlaid audio-video feed and transmit the overlaid audio-video feed using the audio-video output connection. In one embodiment, a home automation gateway is a television receiver, such as a television receiver useful with a satellite television system, a cable television system or an IPTV system.

Optionally, the processor-readable instructions further cause the one or more processors to store the sensor data to persistent memory. Optionally, the sensor data includes video or audio from a closed circuit camera system. Optionally, the processor-readable instructions further cause the one or more processors to generate a live video feed acquired by the closed-circuit camera system. Optionally, the processor-readable instructions further cause the one or more processors to: generate a video feed acquired by the closed-circuit camera system over a predetermined time period before or after the possible alarm event. As described above, these optional features advantageously allow a user to view a live feed of video from a closed circuit camera system or a video feed from a closed circuit camera system during the moments before and/or after the event of interest to allow the user to analyze the situation and determine whether the alarm event is a false alarm event or an actual alarm event.

In some embodiments, for example, the processor-readable instructions further cause the one or more processors to transmit a notification of the signal, wherein receiving the notification at a presentation device generates a display of the notification. In embodiments, the notification includes the request for user input. In some embodiments, for example, the processor-readable instructions further cause the one or more processors to transmit a notification of user input received specifying that the possible alarm event is a false alarm event or an actual alarm event, such as for purposes of informing other users and/or devices that user input has been received.

Optionally, a device of this aspect further comprises a network connection and/or network hardware associated with making network connections to a digital data network. Optionally, the device is connected to a network. Optionally, the instructions that cause the one or more processors to receive sensor data from the one or more sensors cause the one or more processors to receive sensor data over the network.

In embodiments, aspects of the invention are implemented in hardware and/or software. In specific embodiments, aspects of the invention utilize software that is run on a mobile operating system or on a mobile device. For example, in one embodiment, a software product is configured as an application for a mobile device, such as a smartphone or a tablet, which provides access to the user to sensor data from one or more sensors associated with a home automation system. Optionally, the software causes the mobile device to display data received over a network from a one or more sensors associated with a home automation system, such as by way of a home automation gateway that collects, analyzes, records and/or otherwise processes the sensor data. Optionally, the software causes the mobile device to receive user input in response to notifications received at the mobile device. Optionally, the software forwards user input received at the mobile device to a remote system, such as a home automation system or associated components.

In another aspect, provided are computer program products. For example, in one embodiment a computer program product comprises a non-transitory computer readable medium including instructions that, when executed by one or more processors, cause the one or more processors to perform a method disclosed herein. For example, in one embodiment, a computer program product comprises a non-transitory computer readable medium including instructions that, when executed by one or more processors, cause the one or more processors to receive a signal from one or more sensors indicating a possible alarm event; receive sensor data from the one or more sensors; transmit the sensor data; transmit a request for user input to confirm the possible alarm event; and detect user input specifying that the possible alarm event is a false alarm event. Optionally, when the sensor data is received at a presentation device, the presentation device generates a display of the sensor data. In various embodiments, the presentation device is a mobile phone, a smartphone, a smartwatch, a tablet, an e-reader, a personal digital assistant, a personal computer, a laptop computer, a television, a monitor, a car computer or stereo system, a heads up display, a head mounted display device, and the like.

Other aspects and/or implementations are possible.

DETAILED DESCRIPTION

Figure 1:
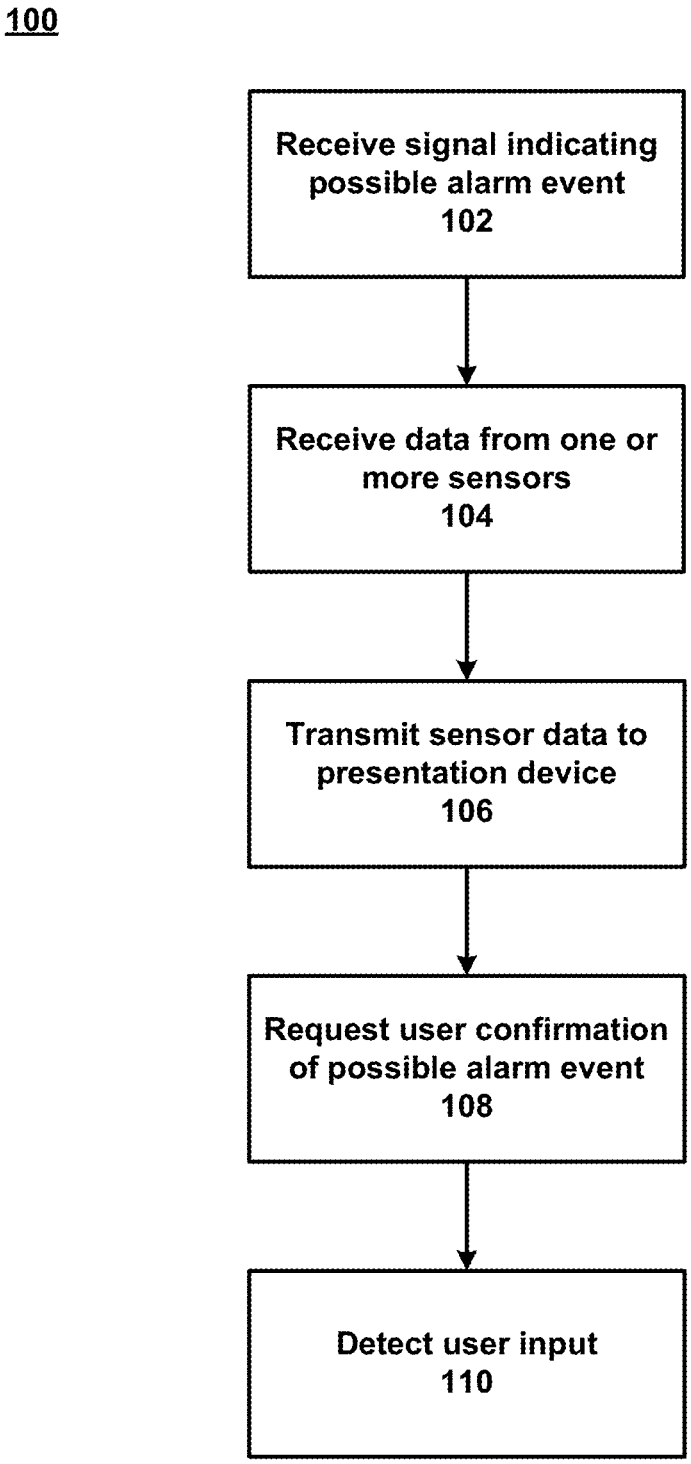
FIG. 1 shows an example method according to the disclosure.

The present disclosure is directed to or towards systems and methods for enabling an end-user to identify whether alarm events are true alarm events, which may require, for example, police, firefighting, rescue, security or emergency assistance, or whether alarm events are false alarm events. Advantageously, such an implementation may serve to minimize monitored notifications to emergency or security authorities and to provide a flexible home security type system to users of home automation systems. Although not so limited, an appreciation of the various aspects of the present disclosure may be gained from the following discussion in connection with the drawings. For instance, referring now to FIG. 1, an example method 100 is shown in accordance with the principles of the present disclosure. It is contemplated that aspects of the method 100 may be implemented wholly or at least partially by a satellite television receiver, consistent with the example of a satellite television implementation as discussed throughout. In other embodiments, aspects of method 100 may be implemented wholly or at least partially by a home automation system or a component thereof At step 102, a signal is received that indicates a possible alarm event has occurred. Such alarm events can be similar to conventional home security alarm events (door opened, motion detected, window broken, smoke detected, fire detected, etc.), or can be user configured to match any event which may generate a detectable trigger, such as an event that may be detected by one or more sensors. Non limiting examples of detectable triggers include a doorbell press, a water sensor detecting water from rain or a leak or a microphone detecting sound above a threshold decibel level. Other examples are possible, as described herein.

At step 104, data is received from one or more sensors. Optionally, the data received is recorded. In some embodiments, data from the one or more sensors may be continually received, both before and after a possible alarm event. As step 106, the sensor data is transmitted to a presentation device, for example to facilitate generation of a display of the sensor data to a user. The sensor data may be transmitted via any number of formats to facilitate the display of the data to a user. For example, in one embodiment, the sensor data is transmitted as raw (unmodified) sensor data and the display device may present the raw sensor data to the user or may modify the sensor data for display in a suitable format. In another embodiment, the sensor data is encoded or otherwise rendered to a format suitable before it is transmitted to the presentation device for display. For example, the sensor data may be encoded into an audio/video signal that can be interpreted and displayed by a television, such as a high-definition media interface (HDMI) signal.

For example, sensor data received is a live security camera feed, such as a feed from a closed circuit camera connected to a home automation system over a wired or wireless network. A "live" security camera feed is an example of home automation data or information currently or instantly being acquired in time. Optionally, a clip or segment of a security camera feed that is recorded or stored to a persistent memory location for a particular period of time is an example of sensor data previously acquired in time that may further or alternatively be transmitted. Other examples are possible.

At step 108, a request for user input for confirmation of the possible alarm event is generated. In this way, the user can review the sensor data to make a determination of whether the possible alarm event is an actual alarm event or a false alarm event. The request for user input is optionally displayed by a presentation device, such as a television display or a mobile device display, such as a smartphone display or a laptop display. Other presentation devices are contemplated, including, but not limited to a smartwatch, a tablet, an e-reader, a personal digital assistant, a personal computer, a laptop computer, a monitor, a car computer or stereo system, a heads up display, a head mounted display device and the like. At step 110, user input is detected, such as user input that confirms the event is a false alarm event or is an actual alarm event. Other user input may be detected, such as a user request for further sensor data, a user request to forward a notification to another user, etc. In this way, a user's confirmation of an alarm event can be detected and further action taken in response to a confirmed actual alarm event or no action taken in response to a false alarm event.

Further scenarios and/or beneficial aspects associated with enabling an end-user to access home automation features or functionality directly from or via one or more presentation devices are described in detail below in connection with FIGS. 2-9.

Figure 2:
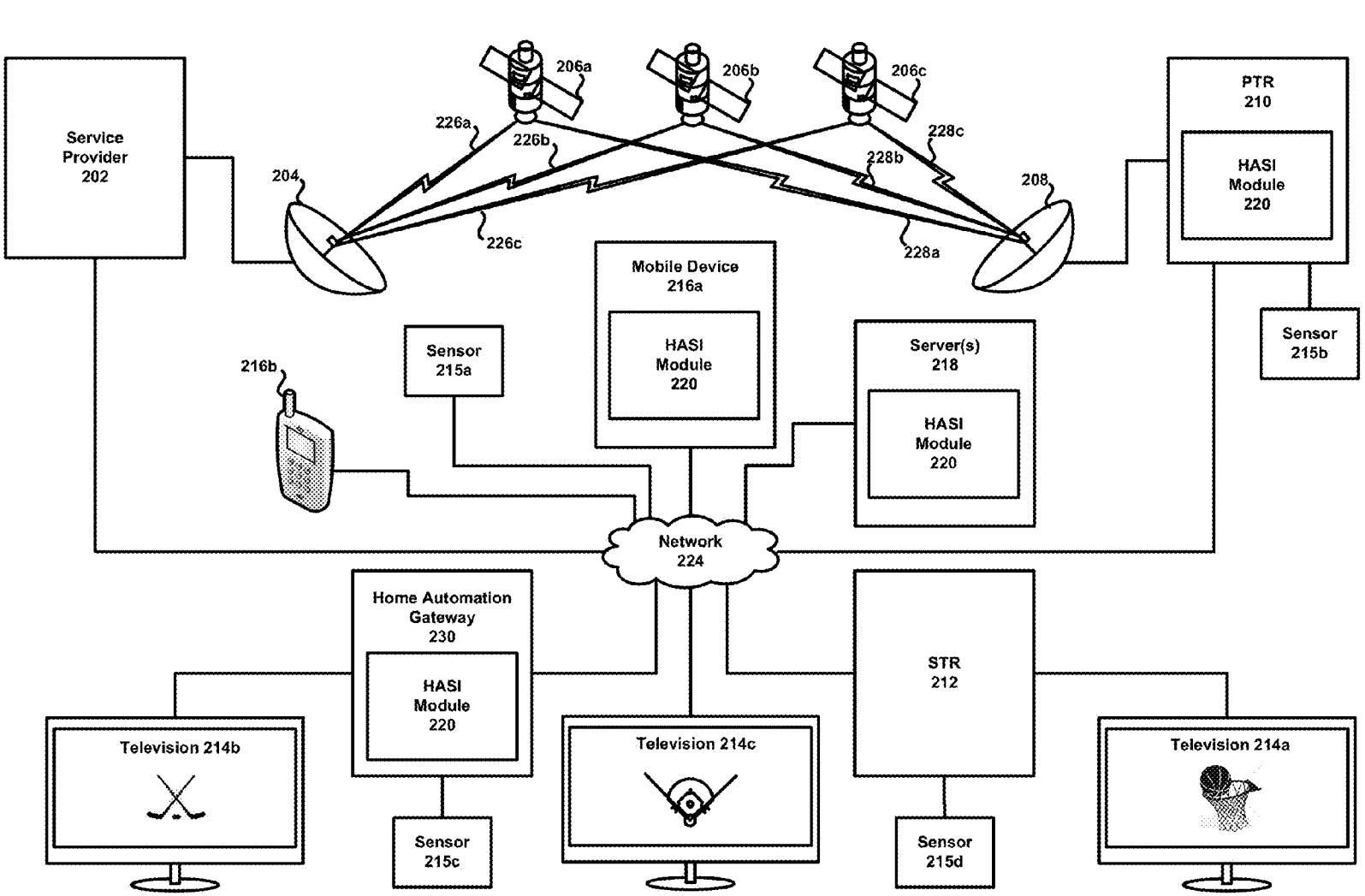
FIG. 2 shows an example content distribution system according to the disclosure.

Referring now to FIG. 2, an example satellite television distribution system 200 is depicted. For brevity, the system 200 is depicted in a simplified form, and may include more or fewer systems, devices, networks, and/or other components as desired. Further, number and type of features or elements incorporated within the system 200 may or may not be implementation-specific, and at least some of the aspects of the system 200 may be similar to or substituted by a cable television distribution system, an IPTV (Internet Protocol Television) content distribution system, and/or any other type of content distribution system. Further, satellite television distribution system 200 is shown as an exemplary system and other television and video systems are contemplated and are useful with the home automation systems described herein, including, but not limited to cable television systems, IPTV systems, over the air broadcast television systems. In addition, the home automation systems described herein are optionally useful with no video system (i.e., as a stand-alone home automation system) or with non-networked video systems, such as DVD and Blu-Ray players.

The example system 200 may include a service provider 202, a satellite uplink 204, a plurality of satellites 206*a-c*, a satellite dish 208, a PTR (Primary Television Receiver) 210, a STR (Secondary Television Receiver) 212, a plurality of televisions 214*a-c*, a plurality of computing devices 216*a-b*, at least one server 218 that may in general be associated with or operated or implemented by the service provider 202, and a home automation gateway 230 Additionally, the PTR 210, computing devices 216*a-b*, server 218 and home automation gateway 230 may include or otherwise exhibit a HASI (Home Automation System Integration) module 220. In general, and as discussed in further detail below, the HASI module 220 may be configured and/or arranged for enabling an end-user to access home automation features or functionality directly from or via one or more interfaces that might normally be used to access television-related programming and services, in accordance with the principles of the present disclosure.

The system 200 may further include at least one network 224 that establishes a bi-directional communication path for data transfer between and among each respective element of the system 200, outside or separate from the unidirectional satellite signaling path. The network 224 is intended to represent any number of terrestrial and/or non-terrestrial network features or elements. For example, the network 224 may incorporate or exhibit any number of features or elements of various wireless and/or hardwired packet-based communication networks such as, for example, a WAN (Wide Area Network) network, a HAN (Home Area Network) network, a LAN (Local Area Network) network, a WLAN (Wireless Local Area Network) network, the Internet, a cellular communications network, or any other type of communication network configured such that data may be transferred between and among elements of the system 200.

The PTR 210, and the STR 212, as described throughout may generally be any type of television receiver, television converter, etc., such as a STB for example. In another example, the PTR 210, and the STR 212, may exhibit functionality integrated as part of or into a television, a DVR (Digital Video Recorder), a computer such as a tablet computing device, or any other computing system or device, as well as variations thereof. Further, the PTR 210 and the network 224, together with the STR 212 and televisions 214*a-c*, and possibly the sensors 215*a-d* and computing devices 216*a-b*, may each be incorporated within or form at least a portion of a particular home computing network. Further, the PTR 210 may be configured so as to enable communications in accordance with any particular communication protocol(s) and/or standard(s) including, for example, TCP/IP (Transmission Control Protocol/Internet Protocol), DLNA/DTCP-IP (Digital Living Network Alliance/Digital Transmission Copy Protection over Internet Protocol), HDMI/HDCP (High-Definition Multimedia Interface/High-bandwidth Digital Content Protection), etc. Other examples are possible. For example, one or more of the various elements or components of the example system 200 may be configured to communicate in accordance with the MoCA® (Multimedia over Coax Alliance) home entertainment networking standard. Still other examples are possible.

In practice, the satellites 206*a-c* may each be configured to receive uplink signals 226*a-c* from the satellite uplink 204. In this example, each the uplink signals 226*a-c* may contain one or more transponder streams of particular data or content, such as one or more particular television channels, as supplied by the service provider 202. For example, each of the respective uplink signals 226*a-c* may contain various media or media content such as encoded HD (High Definition) television channels, SD (Standard Definition) television channels, on-demand programming, programming information, and/or any other content in the form of at least one transponder stream, and in accordance with an allotted carrier frequency and bandwidth. In this example, different media content may be carried using different ones of the satellites 206*a-c*.

Further, different media content may be carried using different transponders of a particular satellite (e.g., satellite 206*a*); thus, such media content may be transmitted at different frequencies and/or different frequency ranges. For example, a first and second television channel may be carried on a first carrier frequency over a first transponder of satellite 206*a*, and a third, fourth, and fifth television channel may be carried on second carrier frequency over a first transponder of satellite 206*b*, or, the third, fourth, and fifth television channel may be carried on a second carrier frequency over a second transponder of satellite 206*a*, etc. Each of these television channels may be scrambled such that unauthorized persons are prevented from accessing the television channels.

The satellites 206*a-c* may further be configured to relay the uplink signals 226*a-c* to the satellite dish 208 as downlink signals 228*a-c*. Similar to the uplink signals 226*a-c*, each of the downlink signals 228*a-c* may contain one or more transponder streams of particular data or content, such as various encoded and/or at least partially electronically scrambled television channels, on-demand programming, etc., in accordance with an allotted carrier frequency and bandwidth. The downlink signals 228*a-c*, however, may not necessarily contain the same or similar content as a corresponding one of the uplink signals 226*a-c*. For example, the uplink signal 226*a* may include a first transponder stream containing at least a first group or grouping of television channels, and the downlink signal 228*a* may include a second transponder stream containing at least a second, different group or grouping of television channels. In other examples, the first and second group of television channels may have one or more television channels in common. In sum, there may be varying degrees of correlation between the uplink signals 226*a-c* and the downlink signals 228*a-c*, both in terms of content and underlying characteristics.

Further, satellite television signals may be different from broadcast television or other types of signals. Satellite signals may include multiplexed, packetized, and modulated digital signals. Once multiplexed, packetized and modulated, one analog satellite transmission may carry digital data representing several television stations or service providers. Some examples of service providers include HBO®, CBS®, ESPN®, and etc. Further, the term "channel," may in some contexts carry a different meaning from or than its normal, plain language meaning For example, the term "channel" may denote a particular carrier frequency or sub-band which can be tuned to by a particular tuner of a television receiver. In other contexts though, the term "channel" may refer to a single program/content service such as HBO®.

Additionally, a single satellite may typically have multiple transponders (e.g., 32 transponders) each one broadcasting a channel or frequency band of about 24-27 MHz in a broader frequency or polarity band of about 500 MHz. Thus, a frequency band of about 500 MHz may contain numerous sub-bands or channels of about 24-27 MHz, and each channel in turn may carry a combined stream of digital data comprising a number of content services. For example, a particular hypothetical transponder may carry HBO®, CBS®, ESPN®, plus several other channels, while another particular hypothetical transponder may itself carry 3, 4, 5, 6, etc., different channels depending on the bandwidth of the particular transponder and the amount of that bandwidth occupied by any particular channel or service on that transponder stream. Further, in many instances a single satellite may broadcast two orthogonal polarity bands of about 500 MHz. For example, a first polarity band of about 500 MHz broadcast by a particular satellite may be left-hand circular polarized, and a second polarity band of about 500 MHz may be right-hand circular polarized. Other examples are possible.

Continuing with the example scenario, the satellite dish 208 may be provided for use to receive television channels (e.g., on a subscription basis) provided by the service provider 202, satellite uplink 204, and/or satellites 206*a-c*. For example, the satellite dish 208 may be configured to receive particular transponder streams, or downlink signals 228*a-c*, from one or more of the satellites 206*a-c*. Based on the characteristics of the PTR 210 and/or satellite dish 208, however, it may only be possible to capture transponder streams from a limited number of transponders concurrently. For example, a particular tuner of the PTR 210 may be configured to tune to a single transponder stream from a transponder of a single satellite at a time.

Additionally, the PTR 210, which is communicatively coupled to the satellite dish 208, may subsequently select a tuner, decode, and relay particular transponder streams to the television 214*c* for display thereon. For example, the satellite dish 208 and the PTR 210 may, respectively, be configured to receive, decode, and relay at least one premium HD-formatted television channel to the television 214*c*. Programming or content associated with the HD channel may generally be presented live, or from a recording as previously stored on, by, or at the PTR 210. Here, the HD channel may be output to the television 214*c* in accordance with the HDMI/HDCP content protection technologies. Other examples are possible.

Further, the PTR 210 may select a tuner, decode, and relay particular transponder streams to one or both of the STR 212, which may in turn relay particular transponder streams to corresponding televisions 214*a* for display thereon. For example, the satellite dish 208 and the PTR 210 may, respectively, be configured to receive, decode, and relay at least one television channel to the television 214*a* by way of the STR 212. Similar to the above-example, the television channel may generally be presented live, or from a recording as previously stored on the PTR 210, and may be output to the television 214*a* by way of the STR 212 in accordance with a particular content protection technology and/or networking standard. Still further, the satellite dish 208 and the PTR 210 may, respectively, be configured to receive, decode, and relay at least one premium television channel to one or each of the computing devices 216*a-c*. Similar to the above-examples, the television channel may generally be presented live, or from a recording as previously stored on the PTR 210, and may be output to one or both of the computing devices 216*a-c* in accordance with a particular content protection technology and/or networking standard.

In various embodiments, a standalone home automation gateway 230 is incorporated into system 200. For example, gateway 230 may include or otherwise exhibit a HASI module 220 to allow for gateway 230 to enable an end-user to access home automation features or functionality, such as, for example, directly from a display device like television 214*b*. Gateway 230 optionally includes a connection to network 224 to allow it to receive sensor data and signals from sensors 215*a-d*, to relay home automation information to and receive input from other devices connected to network 224, such as PTR 210, STR 212, or mobile devices 216*a-b*. Although gateway 230 is shown as connected directly to television 214*b*, such a home automation gateway is optionally not connected directly to any display device and optionally does not include an audio/video output connection for connection directly to a display device.

Home automation gateway 230 optionally includes audio/video input and/or output connections to allow for audio/video signals to be received and/or passed to the connected display device. For example, in one embodiment, audio/video signals are received at gateway 230 and passed to television 214*b*, with home automation information optionally overlaid on the audio/video signals. Such a configuration advantageously allows gateway 230 to be useful in systems having utilizing other television delivery methods, such as cable, IPTV, etc., or with other audio/video components, such as a Blu-ray player, a DVD player, STBs, etc.

One or more sensors 215*a-d* may be incorporated into system 200, such as for providing monitoring of home automation aspects of a building or residence. In various embodiments, sensors 215*a-d* are directly attached to network 224, PTR 210, STR 212, gateway 230 or otherwise configured to provide sensor signals to various aspects of system 200. In one example, sensor 215*a* is attached to network 224 by way of a wired or wireless network connection and can provide signals, data or other information to any or all of the components of system 200. In a specific example, sensor 215*a* communicates using one or more wireless protocols, such as ZigBee, Bluetooth, Z-Wave, WiFi, etc. For example, in one embodiment, sensor 215*a* comprises a wireless closed circuit camera system providing a video feed to HASI module 220.

Figure 3:
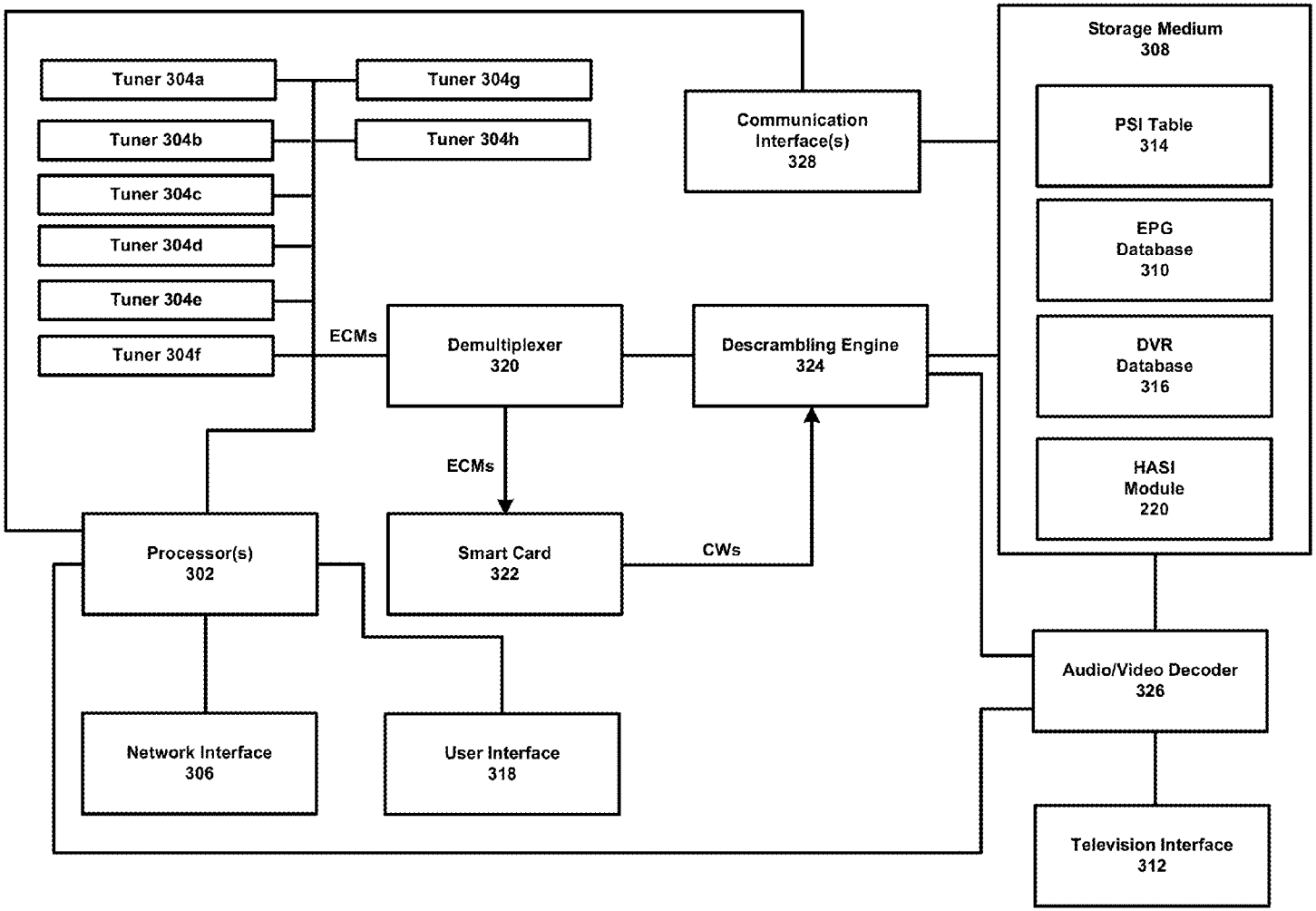
FIG. 3 shows an example block diagram of a television receiver.

Referring now to FIG. 3, an example block diagram of one embodiment of a PTR is shown, such as PTR 210 of FIG. 2. In some examples, the STR may be configured in a manner similar to that of a PTR. In some examples, the STR 212 may be configured and arranged to exhibit a reduced functionality as compared to the PTR 210, and may depend at least to a certain degree on the PTR 210 to implement certain features or functionality. The STR 212 in such an example may be each referred to as a "thin client."

The PTR 210 may include one or more processors 302, a plurality of tuners 304*a-h*, at least one network interface 306, at least one non-transitory computer-readable storage medium 308, at least one EPG (Electronic Programing Guide) database 310, at least one television interface 312, at least one PSI (Program Specific Information) table 314, at least one DVR database 316, at least one user interface 318, at least one demultiplexer 320, at least one smart card 322, at least one descrambling engine 324, at least one decoder 326, and at least one communication interface 328. In other examples, fewer or greater numbers of components may be present. Further, functionality of one or more components may be combined; for example, functions of the descrambling engine 324 may be performed by the processors 302. Still further, functionality of components may be distributed among additional components, and possibly additional systems such as, for example, in a cloud-computing implementation.

The processors 302 may include one or more specialized and/or general-purpose processors configured to perform processes such as tuning to a particular channel, accessing and displaying EPG information, receiving and processing input from a user, etc. For example, the processors 302 may include one or more processors dedicated to decoding video signals from a particular format, such as according to a particular MPEG (Motion Picture Experts Group) standard, for output and display on a television, and for performing or at least facilitating decryption or descrambling.

The tuners 304*a-h* may be used to tune to television channels, such as television channels transmitted via satellites 206*a-c*. Each one of the tuners 304*a-h* may be capable of receiving and processing a single stream of data from a satellite transponder, or a cable RF channel, at a given time. As such, a single tuner may tune to a single transponder or, for a cable network, a single cable channel. Additionally, one tuner (e.g., tuner 304*a*) may be used to tune to a television channel on a first transponder stream for display using a television, while another tuner (e.g., tuner 304*b*) may be used to tune to a television channel on a second transponder for recording and viewing at some other time. If multiple television channels transmitted on the same transponder stream are desired, a particular tuner (e.g., tuner 304*c*) may be used to receive the signal containing the multiple television channels for presentation and/or recording of each of the respective multiple television channels, such as in a PTAT (Primetime Anytime) implementation for example. Although eight tuners are shown, the PTR 210 may include more or fewer tuners (e.g., three tuners, sixteen tuners, etc.), and the features of the disclosure may be implemented similarly and scale according to the number of tuners of the PTR 210.

The network interface 306 may be used to communicate via alternate communication channel(s) with a service provider. For example, the primary communication channel between the service provider 202 of FIG. 2 and the PTR 210 may be via satellites 206*a-c*, which may be unidirectional to the PTR 210, and another communication channel between the service provider 202 and the PTR 210, which may be bidirectional, may be via the network 224. In general, various types of information may be transmitted and/or received via the network interface 306.

The storage medium 308 may represent a non-transitory computer-readable storage medium. The storage medium 308 may include memory and/or a hard drive. The storage medium 308 may be used to store information received from one or more satellites and/or information received via the network interface 306. For example, the storage medium 308 may store information related to the EPG database 310, the PSI table 314, and/or the DVR database 316, among other elements or features, such as the HASI module 220 mentioned above. Recorded television programs may be stored using the storage medium 308 and ultimately accessed therefrom.

The EPG database 310 may store information related to television channels and the timing of programs appearing on such television channels. Information from the EPG database 310 may be used to inform users of what television channels or programs are available, popular and/or provide recommendations. Information from the EPG database 310 may be used to generate a visual interface displayed by a television that allows a user to browse and select television channels and/or television programs for viewing and/or recording. Information used to populate the EPG database 310 may be received via the network interface 306 and/or via satellites 206*a-c* of FIG. 2. For example, updates to the EPG database 310 may be received periodically or at least intermittently via satellite. The EPG database 310 may serve as an interface for a user to control DVR functions of the PTR 210, and/or to enable viewing and/or recording of multiple television channels simultaneously.

The decoder 326 may convert encoded video and audio into a format suitable for output to a display device. For instance, the decoder 326 may receive MPEG video and audio from the storage medium 308, or the descrambling engine 324, to be output to a television. MPEG video and audio from the storage medium 308 may have been recorded to the DVR database 316 as part of a previously-recorded television program. The decoder 326 may convert the MPEG video and audio into a format appropriate to be displayed by a television or other form of display device and audio into a format appropriate to be output from speakers, respectively. The decoder 326 may be a single hardware element capable of decoding a finite number of television channels at a given time, such as in a time-division arrangement. In the example embodiment, eight television channels may be decoded concurrently or simultaneously.

The television interface 312 output a signal to a television, or another form of display device, in a proper format for display of video and play back of audio. As such, the television interface 312 may output one or more television channels, stored television programming from the storage medium 308, such as television programs from the DVR database 316 and/or information from the EPG database 310 for example, to a television for presentation.

The PSI table 314 may store information used by the PTR 210 to access various television channels. Information used to populate the PSI table 314 may be received via satellite, or cable, through the tuners 304*a-h* and/or may be received via the network interface 306 over the network 224 from the service provider 202 shown in FIG. 2. Information present in the PSI table 314 may be periodically or at least intermittently updated. Information that may be present in the PSI table 314 may include: television channel numbers, satellite identifiers, frequency identifiers, transponder identifiers, ECM PIDs (Entitlement Control Message, Packet Identifier), one or more audio PIDs, and video PIDs. A second audio PID of a channel may correspond to a second audio program, such as in another language. In some examples, the PSI table 314 may be divided into a number of tables, such as a NIT (Network Information Table), a PAT (Program Association Table), and a PMT (Program Management Table).

Table 1 below provides a simplified example of the PSI table 314 for several television channels. It should be understood that in other examples, many more television channels may be represented in the PSI table 314. The PSI table 314 may be periodically or at least intermittently.

As such, television channels may be reassigned to different satellites and/or transponders, and the PTR 210 may be able to handle this reassignment as long as the PSI table 314 is updated.

TABLE 1

| Channel | Satellite | Transponder | ECM PID | Audio PIDs | Video PID |
|---|---|---|---|---|---|
| 4 | 1 | 2 | 27 | 2001 | 1011 |
| 5 | 2 | 11 | 29 | 2002 | 1012 |
| 7 | 2 | 3 | 31 | 2003 | 1013 |
| 13 | 2 | 4 | 33 | 2003, 2004 | 1013 |

It should be understood that the values provided in Table 1 are for example purposes only. Actual values, including how satellites and transponders are identified, may vary.

Additional information may also be stored in the PSI table 314. Video and/or audio for different television channels on different transponders may have the same PIDs. Such television channels may be differentiated based on which satellite and/or transponder to which a tuner is tuned.

DVR functionality of the PTR 210 may permit a television channel to be recorded for a period of time. The DVR database 316 may store timers that are used by the processors 302 to determine when a television channel should be tuned to and recorded to the DVR database 316 of storage medium 308. In some examples, a limited amount of space of the storage medium 308 may be devoted to the DVR database 316. Timers may be set by the service provider 202 and/or one or more users of the PTR 210. DVR functionality of the PTR 210 may be configured by a user to record particular television programs. The PSI table 314 may be used by the PTR 210 to determine the satellite, transponder, ECM PID, audio PID, and video PID.

The user interface 318 may include a remote control, physically separate from PTR 210, and/or one or more buttons on the PTR 210 that allows a user to interact with the PTR 210.

The user interface 318 may be used to select a television channel for viewing, view information from the EPG database 310, and/or program a timer stored to the DVR database 316 wherein the timer may be used to control the DVR functionality of the PTR 210.

Referring back to the tuners 304*a-h*, television channels received via satellite may contain at least some encrypted or scrambled data. Packets of audio and video may be scrambled to prevent unauthorized users, such as nonsubscribers, from receiving television programming without paying the service provider 202. When one of the tuners 304*a-h* is receiving data from a particular transponder of a satellite, the transponder stream may be a series of data packets corresponding to multiple television channels. Each data packet may contain a PID, which in combination with the PSI table 314, can be determined to be associated with a particular television channel. Particular data packets, referred to as ECMs may be periodically transmitted. ECMs may be encrypted; the PTR 210 may use the smart card 322 to decrypt ECMs.

The smart card 322 may function as the CA (Controlled Access) which performs decryption of encryption data to obtain control words that are used to descramble video and/or audio of television channels. Decryption of an ECM may only be possible when the user (e.g., an individual who is associated with the PTR 210) has authorization to access the particular television channel associated with the ECM. When an ECM is received by the demultiplexer 320 and the ECM is determined to correspond to a television channel being stored and/or displayed, the ECM may be provided to the smart card 322 for decryption.

When the smart card 322 receives an encrypted ECM from the demultiplexer 320, the smart card 322 may decrypt the ECM to obtain some number of control words. In some examples, from each ECM received by the smart card 322, two control words are obtained. In some examples, when the smart card 322 receives an ECM, it compares the ECM to the previously received ECM. If the two ECMs match, the second ECM is not decrypted because the same control words would be obtained. In other examples, each ECM received by the smart card 322 is decrypted; however, if a second ECM matches a first ECM, the outputted control words will match; thus, effectively, the second ECM does not affect the control words output by the smart card 322. When an ECM is received by the smart card 322, it may take a period of time for the ECM to be decrypted to obtain the control words. As such, a period of time, such as about 0.2-0.5 seconds, may elapse before the control words indicated by the ECM can be obtained. The smart card 322 may be permanently part of the PTR 210 or may be configured to be inserted and removed from the PTR 210.

The demultiplexer 320 may be configured to filter data packets based on PIDs. For example, if a transponder data stream includes multiple television channels, data packets corresponding to a television channel that are not desired to be stored or displayed by the user may be ignored by the demultiplexer 320. As such, only data packets corresponding to the one or more television channels desired to be stored and/or displayed may be passed to either the descrambling engine 324 or the smart card 322; other data packets may be ignored. For each channel, a stream of video packets, a stream of audio packets and/or a stream of ECM packets may be present, each stream identified by a PID. In some examples, a common ECM stream may be used for multiple television channels. Additional data packets corresponding to other information, such as updates to the PSI table 314, may be appropriately routed by the demultiplexer 320.

The descrambling engine 324 may use the control words output by the smart card 322 in order to descramble video and/or audio corresponding to television channels for storage and/or presentation. Video and/or audio data contained in the transponder data stream received by the tuners 304*a-h* may be scrambled. The video and/or audio may be descrambled by the descrambling engine 324 using a particular control word. Which control word output by the smart card 322 to be used for successful descrambling may be indicated by a scramble control identifier present within the data packet containing the scrambled video or audio. Descrambled video and/or audio may be output by the descrambling engine 324 to the storage medium 308 for storage, such as part of the DVR database 316 for example, and/or to the decoder 326 for output to a television or other presentation equipment via the television interface 312.

Figure 4:
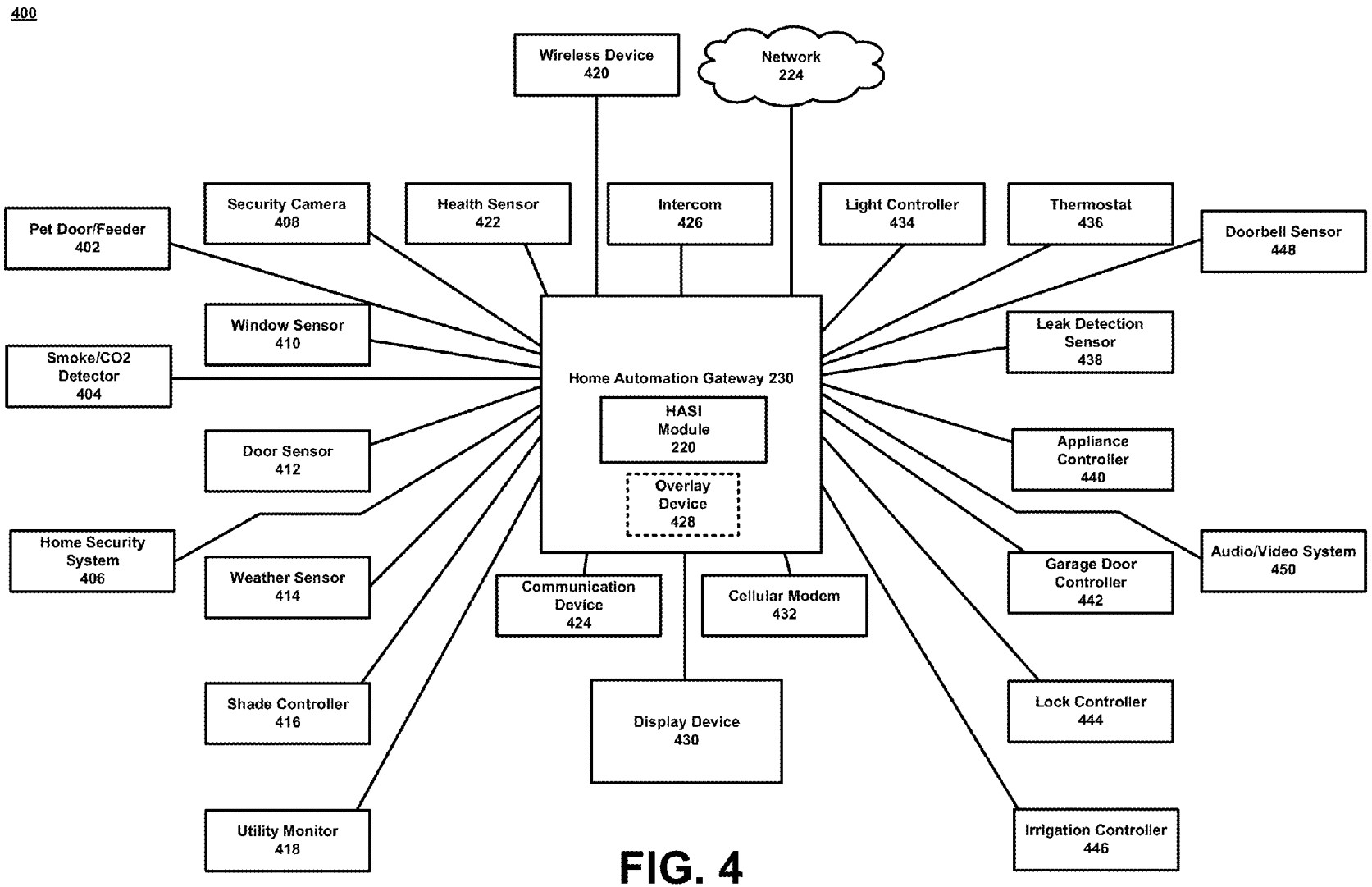
FIG. 4 shows an example home automation system according to the disclosure.

The communication interface 328 may be used by the PTR 210 to establish a communication link or connection between the PTR 210 and one or more of the computing systems and devices and sensors as shown in FIG. 2 and FIG. 4, discussed further below. It is contemplated that the communication interface 328 may take or exhibit any form as desired, and may be configured in a manner so as to be compatible with a like component or element incorporated within or to a particular one of the computing systems and devices as shown in FIG. 2 and FIG. 4, and further may be defined such that the communication link may be wired and/or or wireless. Example technologies consistent with the principles or aspects of the present disclosure may include, but are not limited to, Bluetooth®, WiFi, NFC (Near Field Communication), HomePlug®, and/or any other communication device or subsystem similar to that discussed below in connection with FIG. 9.

For brevity, the PTR 210 is depicted in a simplified form, and may generally include more or fewer elements or components as desired, including those configured and/or arranged for implementing various features for enabling an end-user to access home automation features or functionality directly from or via one or more interfaces that might normally be used to access satellite television-related programming and services, in accordance with the principles of the present disclosure. For example, the PTR 210 is shown in FIG. 3 to include the HASI module 220 as mentioned above in connection with FIG. 2. While shown stored to the storage medium 308 as executable instructions, the HASI module 220 could, wholly or at least partially, be stored to the processor(s) 302 of the PTR 210. Further, some routing between the various modules of PTR 210 has been illustrated. Such illustrations are for exemplary purposes only. The state of two modules not being directly or indirectly connected does not indicate the modules cannot communicate. Rather, connections between modules of the PTR 210 are intended only to indicate possible common data routing. It should be understood that the modules of the PTR 210 may be combined into a fewer number of modules or divided into a greater number of modules.

Additionally, although not explicitly shown in FIG. 3, the PTR 210 may include one or more logical modules configured to implement a television steaming media functionality that encodes video into a particular format for transmission over the Internet such as to allow users to remotely view and control a home cable, satellite, or personal video recorder system from an Internet-enabled computer with a broadband Internet connection. The Slingbox® by Sling Media, Inc. of Foster City, Calif., is one example of a product that implements such functionality. Further, the PTR 210 may be configured to include any number of other various components or logical modules that are implemented in hardware, software, firmware, or any combination thereof, and such components or logical modules may or may not be implementation-specific.

Referring now to FIG. 4, an example home automation system 400 is shown in accordance with the present disclosure. In a general embodiment, the home automation system 400 is hosted by a home automation gateway 230. In another embodiment, the home automation system 400 is hosted by the PTR 210 of FIG. 2, and thus the PTR 210 may be considered a home automation gateway device or system. For example, the gateway 230 may be configured and/or arranged to communicate with multiple in-home or on-residence home automation-related systems, sensors and/or devices. Examples include, but are not limited to: at least one pet door/feeder 402, at least one smoke/$CO_2$ detector 404, a home security system 406, at least one security camera 408, at least one window sensor 410, at least one door sensor 412, at least one weather sensor 414, at least one shade controller 416, at least one utility monitor 418, at least one wireless device 420, at least one health sensor 422, at least one communication device 424, at least one intercom 426, at least one overlay device 428, at least one display device 430, at least one cellular modem 432, at least one light controller 434, at least one thermostat 436, at least one leak detection sensor 438, at least one appliance controller 440, at least one garage door controller 442, at least one lock controller 444, at least one irrigation controller 446, at least one doorbell sensor 448 and at least one audio/video system 450, such as a television receiver, a STB or a Blu-ray, DVD or other media player. The home automation system 400 of FIG. 4 is just an example. Other examples are possible, as discussed below. Useful display devices 430 include, but are not limited to a mobile phone, a smartphone, a smartwatch, a tablet, an e-reader, a personal digital assistant, a personal computer, a laptop computer, a television, a monitor, a car computer or stereo system, a heads up display, a head mounted display device, a display integrated into an appliance, a display integrated into a heating, ventilation and/or air conditioning system control panel, and the like.

It is contemplated that the each of the elements of FIG. 4, that which with the gateway 230 communicates, may use different communication standards. For instance, one or more elements may use or otherwise leverage a ZigBee® communication protocol, while one or more other devices may communicate with the gateway 230 using a Z-Wave® communication protocol. Other forms of wireless communication may be used by particular elements of FIG. 4 to enable communications to and from the gateway 230, such as any particular IEEE (Institute of Electrical and Electronics Engineers) standard or specification or protocol, such as the IEEE 802.11 technology for example, commonly referred to as WiFi.

In some examples, a separate device may be connected with the gateway 230 to enable communication with the smart home automation systems or devices of FIG. 4. For instance, the communication device 424 as shown coupled with the gateway 230 may take the form of a dongle. In some examples, the communication device 424 may be configured to allow for Zigbee®, Z-Wave®, and/or other forms of wireless communication, such as WiFi or cellular communication. In some examples, the communication device 424 may connect with the gateway 230 via a USB (Universal Serial Bus) port or via some other type of (e.g., wired) communication port, such as an Ethernet port for communication with a IEEE 802.3 type network. Accordingly, the communication device 424 may be powered by the gateway 230 or may be separately coupled with another different particular power source. In some examples, the gateway 230 may be enabled to communicate with a local wireless network and may use communication device in order to communicate with devices that use a ZigBee® communication protocol, Z-Wave® communication protocol, and/or some other wireless communication protocols.

In some examples, the communication device 424 may also serve to allow or enable additional components to be connected with the gateway 230. For instance, the communication device 424 may include additional audio/video inputs (e.g., HDMI), component, and/or composite inputs to allow for additional devices (e.g., Blu-Ray players, cable or satellite STBs) to be connected with the gateway 230, such as audio/video system 450. Such a connection may allow video comprising home automation information to be "overlaid" on video from audio/video system 450, both being output for display by a particular presentation device. Whether home automation information is overlaid onto video on display may be triggered based on a press of a remote control button by an end-user. In various embodiments, gateway 230 includes components, such as software and hardware, to control connected audio/video system 450. For example, gateway 230 may include an infrared receiver and/or transmitter to wirelessly control audio/video system 450 using infrared remote commands. Optionally, gateway 230 includes software and/or hardware for controlling audio/video system 450 using a wired connection, such as by using a Consumer Electronics Control (CEC) implementation to allow for commands to be passed to audio/video system 450 via HDMI or other wired connection.

Regardless of whether the gateway 230 uses the communication device 424 to communicate with any particular home automation device shown in FIG. 4 or other particular home automation device not explicitly shown in FIG. 4, the gateway 230 may be configured to output home automation information for presentation via the display device 430. It is contemplated that the display device 430 could correspond to any particular one of the mobile devices 216*a-b* and televisions 214*a-c* as shown in FIG. 2. Still other examples are possible. Such information may be presented simultaneously, concurrently, in tandem, etc., with any particular video feed received by the gateway 230 via any particular communication channel as discussed above. It is further contemplated that the gateway 230 may also, at any particular instant or given time, output only an input audio/video feed, only television programming or only home automation information based on preferences or commands or selections of particular controls within an interface of or by any particular end-user. Furthermore, an end-user may be able to provide input to the gateway 230 to control the home automation system 400, in its entirety.

In some examples (indicated by intermittent line in FIG. 4), an overlay device 428 is included in gateway 230 to allow or enable home automation information to be presented via the display device 430. It is contemplated that the overlay device 428 may be configured and/or arranged to overlay information, such as home automation information, onto a signal that will ultimately enable the home automation information to be visually presented via the display device 430. In this example, the gateway 230 may receive, decode, descramble, decrypt, store, and/or output a video feed, such as a television program or a video feed from a Blu-ray or other media player. The gateway 230 may output a signal, such as in the form of an HDMI signal. Rather than being directly input to the display device 430, however, the output of the gateway 230 may be input to the overlay device 428. Here, the overlay device 428 may receive the video and/or audio output from the gateway 230.

The overlay device 428 may add additional information to the video and/or audio signal received from the gateway 230 so as to modify or augment or even "piggyback" on the same. That video and/or audio signal may then be output by the overlay device 428 to the display device 430 for presentation thereon. In some examples, the overlay device 428 may include or exhibit an HDMI input/output, with the HDMI output being connected to the display device 430. Although overlay device is shown as a component of gateway 230, optionally, overlay device 428 is a separate, standalone device, receiving input from gateway 230 and/or any other components of system 400 and providing an output signal to display device 430.

While FIG. 4 shows lines illustrating communication between the gateway 230 and other various devices, it will be appreciated that such communication may exist, in addition or in alternate via the communication device 424 and/or the overlay device 428. In other words, any particular input to the gateway 230 as shown in FIG. 4 may additionally, or alternatively, be supplied as input to one or both of the communication device 424 and the overlay device 428.

As alluded to above, the gateway 230 may be used to provide home automation functionality, but the overlay device 428 may be used to modify a particular signal so that particular home automation information may be presented via the display device 430. Further, the home automation functionality as detailed throughout in relation to the gateway 230 may alternatively be provided by or via the overlay device 428. Using the overlay device 428 to present automation information via the display device 430 may be beneficial and/or advantageous in many respects. For instance, it is contemplated that multiple devices may provide input video to the overlay device 428. For instance, audio video system 450, such as a PTR 210, STR 212, a DVD/Blu-Ray player or a separate IPTV or STB device, may provide video programming to the overlay device 428 or gateway 230. Regardless of the source of particular video/audio, the overlay device 428 may output video and/or audio that has been modified or augmented, etc., to include home automation information and then output to the display device 430. As such, regardless of the source of video/audio, the overlay device 428 may modify the audio/video to include home automation information and, possibly, solicit for user input. For instance, in some examples the overlay device 428 may have four video inputs (e.g., four HDMI inputs) and a single video output (e.g., an HDMI output). In other examples, the gateway 230 may directly exhibit such features or functionality. As such, a separate device, such as a Blu-ray player may be connected with a video input of the gateway 230, thus allowing the gateway 230 to overlay home automation information when content from the Blu-Ray player is being output to the display device 430.

Figure 7:
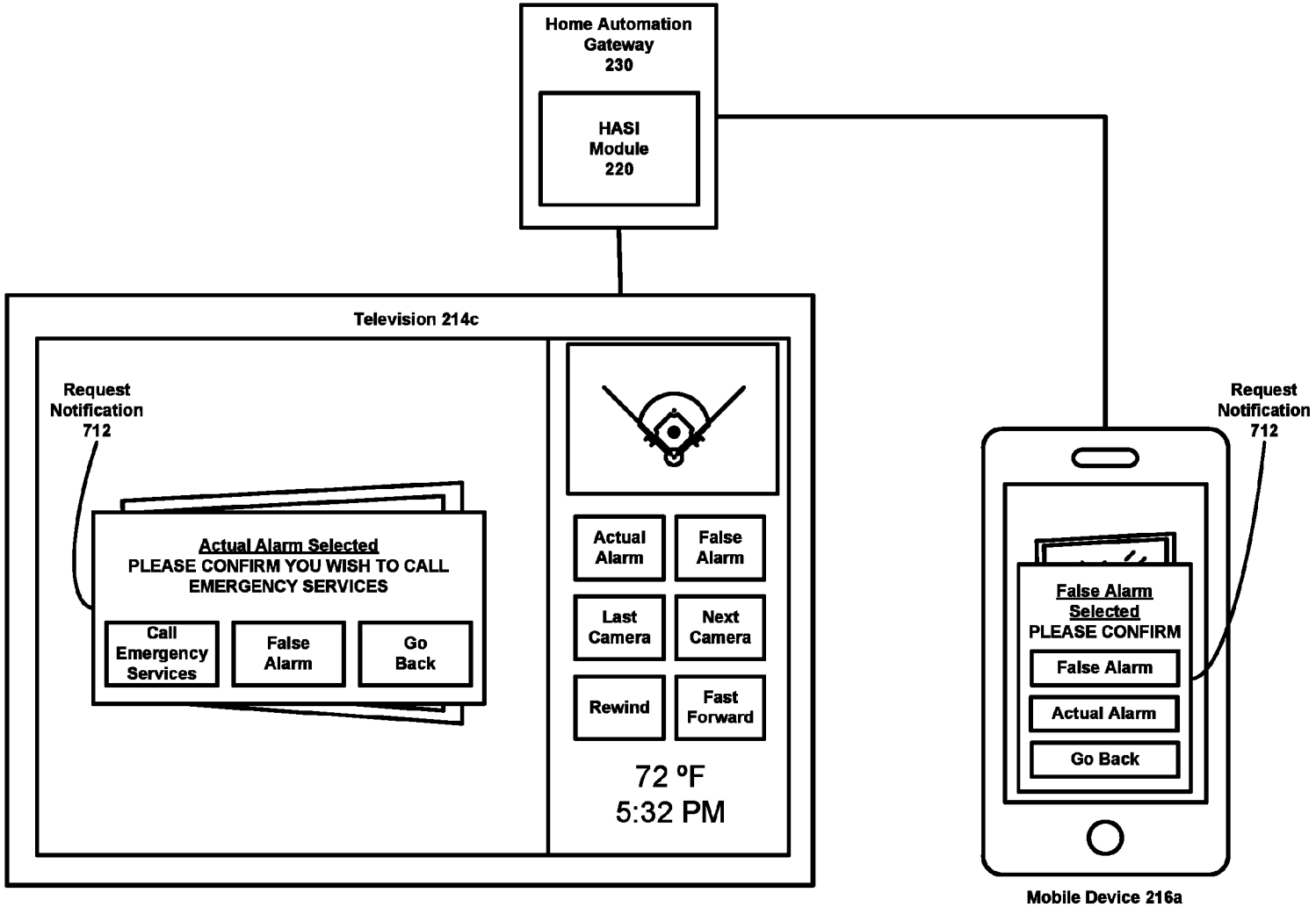
FIG. 7 shows third example aspects of a home automation system.

Regardless of whether the gateway 230 is used exclusively to provide home automation functionality and output home automation input for display via the display device 430 or such home automation functionality is provided via overlay device 428 or PTR 210, home automation information may be presented by the display device 430 while other video programming is also being presented by display device 430. For instance, home automation information may be overlaid or may replace a portion of television programming, such as broadcast content, stored content, on-demand content, etc., presented via the display device 430. As an example, and as discussed in further detail below, FIG. 7 shows an example display by the television 214*c* of FIG. 2, the same of which is supplied to the television 214*c* by the PTR 210 which is configured to host the home automation system 400 in accordance with the principles of the present disclosure. In FIG. 7, while television programming consisting of a baseball game is being presented, the display is augmented with information related to home automation. In general, the television programming may represent broadcast programming, recorded content, on-demand content, or some other form of content. The exemplary illustrated home automation information is related to motion being detected by a camera at a front door of a residence. Such augmentation of the television programming may be performed directly by the gateway 230 (which may or may not be in communication with the communication device 424), the overlay device 428, or even a combination thereof. Such augmentation may result in solid or opaque or partially transparent graphics being overlaid onto television programming (or other forms of video) output by the PTR 210 and displayed by the television 214*c*. Furthermore, the overlay device 428 and/or the gateway 230 may add or modify sound to television programming also or alternatively. For instance, in response to a doorbell ring, a sound may be played through the television 214*c* (or connected audio system). In addition or in alternate, a graphic may be displayed. In other examples, other particular camera data (e.g., nanny camera data) and/or associated sound or motion sensors may be integrated in the system and overlaid or otherwise made available to a user. For example, detection of a crying baby from a nanny camera may trigger an on-screen alert to a user watching television.

Still further, and also as discussed in further detail below in connection with FIG. 7, such presented home automation information may request or at least enable end-user user input. For instance, an end-user may via section of one or more controls of a particular interface output by the gateway 230 (e.g., via a remote control) and/or the overlay device 428, can specify whether video from a camera at the front door should be presented, not presented, or if future notifications related to such motion such be ignored. If ignored, this may be for a predefined period of time, such as an hour, or until the gateway 230 or the overlay device 428 is powered down and powered back on. Ignoring of video may be particularly useful if motion or some other event is triggering the presentation of video that is not interesting to a viewer of the display device 430 (or a wireless device), such as children playing on the lawn or snow falling.

Returning to FIG. 4 alone, the gateway 230 and/or the overlay device 428, depending on implementation-specific details, may communicate with one or more wireless devices, such as the wireless device 420. The wireless device 420 may represent a tablet computer, cellular phone, laptop computer, remote computer, or some other device through which a user may desire to control home automation settings and view home automation information in accordance with the principles of the present disclosure. Such a device also need not necessarily be wireless, such as in a desktop computer embodiment. It is contemplated that the gateway 230, communication device 424, and/or the overlay device 428 may communicate directly with the wireless device 420, or may use a local wireless network, such as network 224 for instance. The wireless device 420 may be remotely located and not connected with a same local wireless network as one or more of the other devices or elements of FIG. 4. Via the Internet, the gateway 230 and/or the overlay device 428 may transmit a notification to the wireless device 420 regarding home automation information. For instance, a third-party notification server system, such as a notification server system operated by Apple Inc., of Cupertino, Calif. may be used to send such notifications to the wireless device 420.

Various home automation devices may be in communication with the HASI module 220 of the gateway 230, the PTR 210 and/or the overlay device 428 (collectively, "gateway 230" hereinafter), depending on implementation-specific details. Such home automation devices may use similar or disparate communication protocols. Such home automation devices may communicate with the gateway 230 directly or via the communication device 424. Such home automation devices may be controlled by a user and/or have a status viewed by a user via the display device 430 and/or wireless device 420. A variety of non-limiting examples of such home automation devices are described below.

One or more cameras, such as the security camera 408 may be integrated in to or as part of the home automation system 400, and each may transmit data to the gateway 230, possibly via the communication device 424. It is contemplated that the security camera 408 may be installed indoors, outdoors, and may provide a video and, possibly, an audio stream that may be presented via the wireless device 420 and/or display device 430. Video and/or audio from the security camera 408 may be recorded by the gateway 230 continuously, in a loop as per a predefined time period, upon an event occurring, such as motion being detected by the security camera 408, and etc. For example, video and/or audio from security camera 408 may be continuously recorded such as in the form of a rolling window, thus allowing a period of time of video/audio to be reviewed by a user from before a triggering event and after the triggering event. Video/audio may be recorded on a persistent storage device local to gateway 230, and/or may be recorded and stored on an external storage devices, such as a network attached storage device or the server 218 of FIG. 2. In some examples, video may be transmitted across a local and/or wide area network to one or more other storage devices upon occurrence of a trigger event, for later playback. For initial setup, for example, a still may be captured by the security camera 408 and stored by the gateway 230 for subsequent presentation as part of a user interface via the display device 430. In this way, an end-user can determine which camera, if multiple cameras are present or enabled, is being set up and/or later accessed. For example, a user interface may display a still image from a front door camera (see e.g., FIG. 7), which may be easily recognized by the user because it shows a scene near or adjacent to a front door of a residence, to allow a user to select the front door camera for viewing as desired.

Furthermore, video and, possibly, audio from the security camera 408 may be available live for viewing by a user via the gateway 230. Such video may be presented simultaneously with television or other video programming being presented. In some examples, video may only be presented if motion is detected by the security camera 408, otherwise video from the security camera 408 may not be presented by a particular display device presenting television programming. Also, such video (and, possibly, audio) from the security camera 408 may be recorded by the gateway 230. As discussed in further detail below in connection with at least FIG. 8, such video may be recorded based upon a user-configurable timer. For instance, features or functionality associated with the security camera 408 may be incorporated into output by the gateway 230 for display by a presentation or display device.

For instance, data as captured by the security camera 408 may be presented or may otherwise be accessible as a "mode" or "channel" of gateway 230 with other typical or conventional television programming channels or video input modes. Accordingly, a user may be permitted to select that channel or mode associated with the security camera 408 to access data as captured by the security camera 408 for presentation via the display device 430 and/or the wireless device 420, etc. The user may also be permitted to set a timer to activate the security camera 408 to record video and/or audio for a user-defined period of time on a user-defined date. Such recording may not be constrained by the rolling window mentioned above associated with a triggering event being detected. Such an implementation may be beneficial, for example, if a babysitter is going to be watching a child and the parents want to later review the babysitter's behavior in their absence. In some examples, video and/audio acquired by the security camera 408 may be backed up to a remote storage device, such as cloud-based storage hosted by the server 218 of FIG. 3 for instance. Other data may also be cached to the cloud, such as configuration settings. Thus, if gateway 230 malfunctions, then a new device may be installed and the configuration data loaded onto the device from the cloud.

Further, one or more window sensors and door sensors, such as the window sensor 410 and the door sensor 412 may be integrated in to or as part of the home automation system 400, and each may transmit data to the gateway 230, possibly via the communication device 424, that indicates the status of a window or door, respectively. Such status may indicate open window or door, an ajar window or door, a closed window or door, and etc. When a status change occurs, an end-user may be notified as such via the wireless device 420 and/or the display device 430. Further, a user may be able to view a status screen or other interface to view the status of one or more window sensors and/or one or more door sensors throughout the location. In some examples, the window sensor 410 and/or the door sensor 412 may have integrated "break" sensors to enable a determination as to whether glass or a hinge, or other integral component, etc., has been broken or compromised. Here, as well as in all instances of home automation related data as acquired and served to the gateway 230 by particular elements of FIG. 4, it is contemplated that one or both of the window sensor 410 and the door sensor 412 may be controlled via interaction with particular controls as provided within an interface of gateway 230, and information or data as acquired by one or both of the window sensor 410 and door sensor 412 may be manipulated, consolidated, etc., as desired, and also made accessible within or an interface, such as a pop-up window, banner, and/or any other "display" or the like, in accordance with the principles of the present disclosure.

Further, one or more smoke and/or $CO_2$ detectors, such as detector 404, may be integrated in to or as part of the home automation system 400. As such, alerts as to whether a fire (e.g., heat, smoke), $CO_2$, radon, etc., has been detected can be sent to the gateway 230, wireless device 420, etc., and/or one or more emergency first responders. Accordingly, when an alert occurs, a user may be notified as such the via wireless device 420 or the display device 430, within an interface for example. Further, it is contemplated that such an interface may be utilized to disable false alarms, and that one or more sensors dispersed throughout a residence and/or integrated within the home automation system 400 to detect gas leaks, radon, or various other dangerous situations. Here, as well as in all instances of home automation related data as acquired and served to the gateway 230 by particular elements of FIG. 4, the detector 404 may be controlled via interaction with particular controls as provided within or by an interface, and information or data as acquired by the detector 404 may be manipulated, consolidated, etc., as desired, and also made accessible within or by interface in accordance with the principles of the present disclosure.

Further, a pet door and/or feeder, such as pet door and/or feeder 402 may be integrated in to or as part of the home automation system 400. For instance, a predefined amount of food may be dispensed at predefined times to a pet. A pet door may be locked and/or unlocked. The pet's weight or presence may trigger the locking or unlocking of the pet door. For instance, a camera located at the pet door may be used to perform image recognition of the pet or a weight sensor near the door may identify the presence of the pet and unlock the door. A user may also lock/unlock a pet door and/or dispense food for example from a "remote" location. Here, as well as in all instances of home automation related data as acquired and served to the gateway 230 by particular elements of FIG. 4, the pet door and/or feeder 402 may be controlled via interaction with particular controls as provided within or by an interface, and information or data as acquired by the pet door and/or feeder 402 may be consolidated, summarized, etc., and made accessible within or by an interface in accordance with the principles of the present disclosure.

Further, a weather sensor, such as the weather sensor 414 may be integrated in to or as part of the home automation system 400, and may allow or enable the gateway 230 to receive, identify, and/or output various forms of environmental data, including local or non-local ambient temperature, humidity, wind speed, barometric pressure, etc. Here, as well as in all instances of home automation related data as acquired and served to the gateway 230 by particular elements of FIG. 4, the weather sensor 414 may be controlled via interaction with particular controls as provided within or by an interface, and information or data as acquired by the pet door and/or feeder 402 may be manipulated, consolidated, etc., as desired, and also made accessible within or by an interface in accordance with the principles of the present disclosure.

Further, a shade controller, such as shade controller 416, may be integrated in to or as part of the home automation system 400, and may allow for control of one or more shades, such as window, door, and/or skylight shades, within a home or residence or any other location. The shade controller 416 may respond to commands received from the gateway 230 and may provide status updates, such as "shade up" or "shade 50% up" or "shade down" and etc. Here, as well as in all instances of home automation related data as acquired and served to the gateway 230 by particular elements of FIG. 4, the shade controller 416 may be controlled via interaction with particular controls as provided within or by an interface, and information or data as acquired by the shade controller 416 may be manipulated, consolidated, etc., as desired, and also made accessible within or by an interface in accordance with the principles of the present disclosure.

Further, a utility monitor, such as utility monitor 418, may be integrated in to or as part of the home automation system 400, and may serve to provide the gateway 230 with utility data or information, such as electricity usage, gas usage, water usage, wastewater usage, irrigation usage, etc. A user may via an interface view a status page or may receive notifications upon predefined events occurring, such as electricity usage exceeding a defined threshold within a month, or current kilowatt usage exceeding a threshold. Here, as well as in all instances of home automation related data as acquired and served to the gateway 230 by particular elements of FIG. 4, the utility monitor 418 may be controlled via interaction with particular controls as provided within or by an interface, and information or data as acquired by the utility monitor 418 may be manipulated, consolidated, etc., as desired, and also made accessible within or by an interface in accordance with the principles of the present disclosure.

Further, a health sensor, such as health sensor 422, may be integrated in to or as part of the home automation system 400, and may permit one or more vital characteristics of a particular individual to be acquired and/or monitored, such as a heart rate for instance. In some examples, additionally or alternatively, the health sensor 422 may contain a button or other type of actuator that a user can press to request assistance. As such, the health sensor 422 may be mounted to a fixed location, such as bedside, or may be carried by a user, such as on a lanyard. Such a request may trigger a notification to be presented to other users via the display device 430 and/or the wireless device 420. Additionally or if the notification is not cleared by another user within a predefined period of time, a notification may be transmitted to emergency first responders to request help. In some examples, a home automation service provider may first try contacting the user, such as via phone, to determine if an emergency is indeed occurring. Such a health sensor 422 may have additional purposes, such as for notification of another form of emergency, such as a break-in, fire, flood, theft, disaster, etc.

In some examples, the health sensor 422 may be used as a medical alert pendant that can be worn or otherwise carried by an individual. It may contain a microphone and/or speaker to allow communication with other users and/or emergency first responders. The gateway 230 may be pre-programmed to contact a particular phone number, such as an emergency service provider, relative, caregiver, etc., based on an actuator of the health sensor 422 being activated by a user. The user may be placed in contact with a person via the phone number and the microphone and/or speaker of the health sensor 422. Furthermore, camera data may be combined with such alerts in order to give a contacted relative more information regarding the medical situation. For example, the health sensor 422, when activated in the family room, may generate a command which is linked with security camera footage from the same room. Furthermore, in some examples, the health sensor 422 may be able to monitor vitals of a user, such as a blood pressure, temperature, heart rate, blood sugar, etc. In some examples, an event, such as a fall or exiting a structure can be detected.

Further, in response to an alert from the health sensor 422 or some other emergency or noteworthy event, parallel notifications may be sent to multiple users at approximately the same time. As such, multiple people can be made aware of the event at approximately the same time (as opposed to serial notification). Therefore, whoever the event is most pertinent to or notices the notification first can respond. Which users are notified for which type of event may be customized by a user of the gateway 230. In addition to such parallel notifications being based on data from the health sensor 422, data from other devices may trigger such parallel notifications. For instance, a mailbox open, a garage door open, an entry/exit door open during wrong time, an unauthorized control of specific lights during vacation period, a water sensor detecting a leak or flow, a temperature of room or equipment is outside of defined range, and/or motion detected at front door are examples of possible events which may trigger parallel notifications.

Additionally, a configuring user may be able to select from a list of users to notify and method of notification to enable such parallel notifications. The configuring user may prioritize which systems and people are notified, and specify that the notification may continue through the list unless acknowledged either electronically or by human interaction. For example, the user could specify that they want to be notified of any light switch operation in their home during their vacation. Notification priority could be: 1) SMS Message; 2) push notification; 3) electronic voice recorder places call to primary number; and 4) electronic voice recorder places call to spouse's or another number. Other examples are possible, however, it is contemplated that the second notification may never happen if the user replies to the SMS message with an acknowledgment. Or, the second notification would automatically happen if the SMS gateway cannot be contacted. Here, as well as in all instances of home automation related data as acquired and served to the gateway 230 by particular elements of FIG. 4, the health sensor 422 may be controlled via interaction with particular controls as provided within or by an interface, and information or data as acquired by the health sensor 422 may be manipulated, consolidated, etc., as desired, and also made accessible within or by an interface in accordance with the principles of the present disclosure.

Further, an intercom, such as the intercom 426, may be integrated in to or as part of the home automation system 400, and may permit a user in one location to communicate with a user in another location, who may be using the wireless device 420, the display device 430, or some other device, such another television receiver within the structure. The intercom 426 may be integrated with the security camera 408 or may use a dedicated microphone/speaker, such as a Bluetooth® microphone. Microphones/speakers of the wireless device 420, display device 430, communication device 424, overlay device 428, etc., may also or alternatively be used. A MOCA network or other appropriate type of network may be used to provide audio and/or video from the intercom 426 to the gateway 230 and/or to other television receivers and/or wireless devices in communication with the gateway 230. Here, as well as in all instances of home automation related data as acquired and served to the gateway 230 by particular elements of FIG. 4, the intercom 426 may be controlled via interaction with particular controls as provided within or by an interface, and information or data as acquired by the intercom 426 may be manipulated, consolidated, etc., as desired, and also made accessible within or by an interface in accordance with the principles of the present disclosure.

Further, a light controller, such as light controller 434, may be integrated in to or as part of the home automation system 400, and may permit a light to be turned on, off, and/or dimmed by the gateway 230, such as based on a user command received from the wireless device 420 or directly via gateway 230. The light controller 434 may control a single light. As such, multiple different instances of the light controller 434 may be present within a house or residence. In some examples, a physical light switch, that opens and closes a circuit of the light, may be left in the "on" position such that light controller 434 can be used to control whether the light is on or off. The light controller 434 may be integrated into a light bulb or a circuit, such as between the light fixture and the power source, to control whether the light is on or off. An end-user, via the gateway 230, may be permitted to view a status of each instance of the light controller 434 within a location.

Since the gateway 230 may communicate using different home automation protocols, different instances of the light controller 434 within a location may use disparate or different communication protocols, but may all still be controlled by the gateway 230 or other device. In some examples, wireless light switches may be used that communicate with the gateway 230.

Such switches may use a different communication protocol than any particular instance of the light controller 434. Such a difference may not affect functionality because the gateway 230 can serve as a hub for multiple disparate communication protocols and perform any necessary translation and/or bridging functions. For example, a tablet computer may transmit a command over a WiFi connection and the gateway 230 may translate the command into an appropriate Zigbee® or Zwave® command for a wireless light bulb. In some examples, the translation may occur for a group of disparate or different devices. For example, a user may decide to turn off all lights in a room and select a lighting command on a tablet computer, the gateway 230 may then identify the lights in the room and output appropriate commands to all devices over different protocols, such as a Zigbee® wireless light bulb and a Zwave® table lamp.

Additionally, it is contemplated that the gateway 230 may permit timers and/or dimmer settings to be set for lights via the light controller 434. For instance, lights can be configured to turn on/off at various times during a day according to a schedule and/or events being detected by the home automation system 400, etc. Here, as well as in all instances of home automation related data as acquired and served to the gateway 230 by particular elements of FIG. 4, each particular instance of the light controller 434 may be controlled via interaction with particular controls as provided within or by an interface, and information or data as acquired by each particular instance of the light controller 434 may be manipulated, consolidated, etc., as desired, and also made accessible within or by an interface in accordance with the principles of the present disclosure.

Further, a thermostat, such as the thermostat 436, may be integrated in to or as part of the home automation system 400, and may provide heating/cooling updates to the gateway 230 for display via display device 430 and/or wireless device 420. Further, control of thermostat 436 may be effectuated via the gateway 230, and zone control within a structure using multiple thermostats may also be possible. Here, as well as in all instances of home automation related data as acquired and served to the gateway 230 by particular elements of FIG. 4, the thermostat 436 may be controlled via interaction with particular controls as provided within or by an interface, and information or data as acquired by the thermostat 436 may be manipulated, consolidated, etc., as desired, and also made accessible within or by an interface in accordance with the principles of the present disclosure.

Further, a leak detection sensor, such as the leak detection sensor 438, may be integrated in to or as part of the home automation system 400, and may be used to determine when a water leak as occurred, such as in pipes supplying water-based fixtures with water. The leak detection sensor 438 may be configured to attach to the exterior of a pipe and listen for a sound of water moving within a pipe. In other examples, sonar, temperature sensors or ion infused water with appropriate sensors may be used to detect moving water. As such, cutting or otherwise modifying plumbing may not be necessary to use or leverage the leak detection sensor 438. If water movement is detected for greater than a threshold period of time, it may be determined a leak is occurring. The leak detection sensor 438 may have a component that couples over an existing valve such that the flow of water within one or more pipes can be stopped.

For instance, if the leak detection sensor 438 determines a leak may be occurring, a notification may be provided to a user via the wireless device 420 and/or display device 430 by the gateway 230. If a user does not clear the notification, the flow of water may be shut off by the leak detection sensor 438 after a predefined period of time. A user may also be able to provide input to allow the flow of water to continue or to immediately interrupt the flow of water. Here, as well as in all instances of home automation related data as acquired and served to the gateway 230 by particular elements of FIG. 4, the leak detection sensor 438 may be controlled via interaction with particular controls as provided within or by an interface, and information or data as acquired by the leak detection sensor 438 may be manipulated, consolidated, etc., as desired, and also made accessible within or by an interface in accordance with the principles of the present disclosure.

Further, a controller, such as the appliance controller 440, may be integrated in to or as part of the home automation system 400, and may permit a status of an appliance to be retrieved and commands to control operation to be sent to an appliance by the gateway 230. For instance, the appliance controller 440 may control a washing machine, a dryer, a dishwasher, an oven, a microwave, a refrigerator, a toaster, a coffee maker, a hot tub, or any other form of appliance. The appliance controller 440 may be connected with a particular appliance or may be integrated as part of the appliance. Additionally, or alternatively, the appliance controller 440 may enable for acquisition of data or information regarding electricity usage of one or more devices (e.g., other home automation devices or circuits within a home that are monitored) to be determined. Here, as well as in all instances of home automation related data as acquired and served to the gateway 230 by particular elements of FIG. 4, the appliance controller 440 may be controlled via interaction with particular controls as provided within or by an interface, and information or data as acquired by the appliance controller 440 may be manipulated, consolidated, etc., as desired, and also made accessible within or by an interface in accordance with the principles of the present disclosure.

Further, a garage door controller, such as the garage door controller 442, may be integrated in to or as part of the home automation system 400, and may permit a status of a garage door to be checked and the door to be opened or closed by a user via the gateway 230. In some examples, based on a physical location of the wireless device 420, the garage door may be controlled. For instance, if the wireless device 420 is a cellular phone and it is detected to have moved a threshold distance away from a house having the garage door controller 442 installed, a notification may be sent to the wireless device 420. If no response is received within a threshold period of time, the garage may be automatically shut. If the wireless device 420 moves within a threshold distance of the garage door controller 442, the garage may be opened. Here, as well as in all instances of home automation related data as acquired and served to the gateway 230 by particular elements of FIG. 4, the garage door controller 442 may be controlled via interaction with particular controls as provided within or by an interface, and information or data as acquired by the garage door controller 442 may be manipulated, consolidated, etc., as desired, and also made accessible within or by an interface in accordance with the principles of the present disclosure.

Further, a lock controller, such as the lock controller 444, may be integrated in to or as part of the home automation system 400, and may permit a door to be locked and unlocked and/or monitored by a user via the gateway 230. In some examples, the lock controller 444 may have an integrated door sensor 412 to determine if the door is open, shut, or partially ajar. Being able to only determine if a door is locked or unlocked may not be overly useful—for instance, a lock may be in a locked position, but if the door is ajar, the lock may not prevent access to the house. Therefore, for security, a user may benefit from knowing both that a door is closed (or open) and locked (or unlocked). To accomplish such notification and control, the lock controller 444 may have an integrated door sensor 412 that allows for the lock controller 444 to lock/unlock a door and provide a status as to whether the door is open or shut. Therefore, a single device may control a lock and determine whether the associated door is shut or open. No mechanical or electrical component may need to be integrated separately into a door or doorframe to provide such functionality. Such a single device may have a single power source that allows for sensing of the lock position, sensing of the door position, and for engagement/disengagement of the lock.

For example, the lock controller 444 may have an integrated door sensor that includes a reed switch or proximity sensor that detects when the door is in a closed position, with a plate of the lock in proximity to a plate on the door frame of the door. For instance, a plate of the lock may have an integrated magnet or magnetized doorframe plate. When in proximity to the magnet, a reed switch located in the lock controller 444 may be used to determine that the door is closed; when not in proximity to the magnet, the reed switch located in the lock controller 444 may be used to determine that the door is at least partially ajar. Rather than using a reed switch, other forms of sensing may also be used, such as a proximity sensor to detect a doorframe. In some examples, the sensor to determine the door is shut may be integrated directly into the deadbolt or other latching mechanism of the lock controller 444. When the deadbolt is extended, a sensor may be able to determine if the distal end of the deadbolt is properly latched within a door frame based on a proximity sensor or other sensing means. Here, as well as in all instances of home automation related data as acquired and served to the gateway 230 by particular elements of FIG. 4, the lock controller 444 may be controlled via interaction with particular controls as provided within or by an interface, and information or data as acquired by the lock controller 444 may be manipulated, consolidated, etc., as desired, and also made accessible within or by an interface in accordance with the principles of the present disclosure.

Further, a home security system, such as the home security system 406, may be integrated in to or as part of the home automation system 400. In general, the home security system 406 may detect motion, when a user has armed/disarmed the home security system 406, when windows/doors are opened or broken, etc. The gateway 230 may adjust settings of the home automation devices of FIG. 4 based on home security system 406 being armed or disarmed. For example, a virtual control and alarm panel may be presented to a user via the display device 430. The functions of a wall mounted panel alarm can be integrated in the graphical user interface of the TV viewing experience such as a menu system with an underlying tree hierarchical structure. It is contemplated that the virtual control and alarm panel can appear in a full screen or PiP (Picture-in-Picture) with TV content. Alarms and event notification can be in the form of scrolling text overlays, popups, flashing icons, etc.

Additionally, camera video and/or audio, such as from the security camera 408, can be integrated with or overlaid on video content provided by the gateway 230 with additional search, zoom, time-line capabilities. The camera's video stream can be displayed full screen, PiP with video content, or as a tiled mosaic to display multiple camera's streams at a same time. In some examples, the display can switch between camera streams at fixed intervals. The gateway 230 may perform video scaling, adjust frame rate and transcoding on video received from the security camera 408. In addition, the gateway 230 may adaptively transcode the camera content to match an Internet connection. Here, as well as in all instances of home automation related data as acquired and served to the gateway 230 by particular elements of FIG. 4, the home security system 406 may be controlled via interaction with particular controls as provided within or by an interface, and information or data as acquired by the home security system 406 may be manipulated, consolidated, etc., as desired, and also made accessible within or by an interface in accordance with the principles of the present disclosure.

Further, an irrigation controller, such as the irrigation controller 446, may be integrated in to or as part of the home automation system 400, and may allow for a status and control of an irrigation system, such as a sprinkler system, to be controlled by a user via the gateway 230. The irrigation controller 446 may be used in conjunction with the weather sensor 414 to determine whether and/or for how long (duration) the irrigation controller 446 should be activated for watering. Further, a user, via the gateway 230, may turn on, turn off, or adjust settings of the irrigation controller 446. Here, as well as in all instances of home automation related data as acquired and served to the gateway 230 by particular elements of FIG. 4, the irrigation controller 446 may be controlled via interaction with particular controls as provided within or by an interface, and information or data as acquired by the irrigation controller 446 may be manipulated, consolidated, etc., as desired, and also made accessible within or by an interface in accordance with the principles of the present disclosure.

Further, a doorbell sensor, such as the doorbell sensor 448, may be integrated in to or as part of the home automation system 400, and may permit an indication of when a doorbell has been rung to be sent to multiple devices, such as the gateway 230 and/or the wireless device 420. In some examples, the doorbell sensor 448 detecting a doorbell ring may trigger video to be recorded by the security camera 408 of the area near the doorbell and the video to be stored until deleted by a user, or stored for predefined period of time. Here, as well as in all instances of home automation related data as acquired and served to the gateway 230 by particular elements of FIG. 4, the doorbell sensor 448 may be controlled via interaction with particular controls as provided within or by an interface, and information or data as acquired by the doorbell sensor 448 may be manipulated, consolidated, etc., as desired, and also made accessible within or by an interface in accordance with the principles of the present disclosure.

For example, "selection" of a doorbell by an individual so as to "trigger" the doorbell sensor 448 may activate or engage the gateway 230 to generate and output for display by a presentation device, such as the television 214*c*, a user interface, display, pop-up, etc., that which may include particular information such as "There is someone at your front door ringing the doorbell" for example. Additional, or alternative, actions such as activating, by the gateway 230, a security camera to record video and/or audio of the individual at the front door are contemplated as well. Further, similar steps or actions may be taken or implemented by the gateway 230 for example in response to a signal generated in response to detection of an event, etc., received by the gateway 230 from any of the elements of FIG. 2.

Additional forms of sensors not illustrated in FIG. 4 may also be incorporated as part of the home automation system 400. For instance, a mailbox sensor may be attached to a mailbox to determine when mail is present and/or has been picked up. The ability to control one or more showers, baths, and/or faucets from the gateway 230 and/or the wireless device 420 may also be possible. Pool and/or hot tub monitors may be incorporated into the home automation system 400. Such sensors may detect whether or not a pump is running, water temperature, pH level, a splash/whether something has fallen in, etc. Further, various characteristics of the pool and/or hot tub may be controlled via the home automation system. In some examples, a vehicle "dashcam" may upload or otherwise make video/audio available to the gateway 230 when within range of a particular residence. For instance, when a vehicle has been parked within range of a local wireless network with which the gateway 230 is connected, video and/or audio may be transmitted from the dashcam to the gateway 230 for storage and/or uploading to a remote server, such as the server 218 as shown in FIG. 2. Here, as well as in all instances of home automation related data as acquired and served to the gateway 230 by particular elements of FIG. 4, such systems or sensors or devices may be controlled via interaction with particular controls as provided within or by an interface, and information or data as acquired by such systems or sensors or devices may be manipulated, consolidated, etc., as desired, and also made accessible within or by an like interface in accordance with the principles of the present disclosure.

For any number of situations, an alert or notification may be generated to inform a user of an event or condition. For example, as described above, some sensors or systems may generate an alert to inform a user of an emergency condition or to notify a user that one or more components of a home security system detect a change, such as a door or window sensor indicating a door or window is opened or a break sensor indicating a window has been broken or a motion sensor indicating that motion is detected, or that a fire or other unsafe condition is detected. In response to such notifications, emergency, fire, police or security services may be notified, so that appropriate personnel can respond to the situation.

Any variety of notifications may be generated by components of a home automation system, including, but not limited to, a smoke detector or carbon monoxide detector generating a notification of unsafe levels of smoke or carbon monoxide, an audio sensor generating a notification of audio signal levels, a home security system generating a notification of a security breach, a window break sensor generating a notification of a broken window, a lock controller generating a notification of a lock being broken or unlocked, such as at an unauthorized time, a door or window sensor generating a notification of a door or window being opened, a leak detection sensor generating a notification that a leak is detected or a gas sensor generating a notification that a dangerous gas has been detected, such as at an unsafe level. Other sources of generation of a notification from other sensors are contemplated, such as a thermostat or temperature sensor generating a notification of an unsafe, high or low, temperature, a health sensor generating a notification of a request for assistance or a dangerous health condition detected or a security camera or motion sensor generating a notification of motion detected.

It may often be desirable to minimize notifying emergency, fire, police or security services, such as by dialing 9-1-1, to respond to notifications for which an actual emergency or unsafe condition is not present, i.e., for conditions that are merely "false alarms." For example, a neighborhood cat triggering a motion sensor that causes a home security system to send an alert would normally not warrant security or police response. Similarly, an accidental press of a medical alert pendant may generate a trigger that emergency personnel would respond to, even though no emergency actually occurred. Some security systems are setup to generate a notification at a security service provider to call the appropriate authorities. In some circumstances, a user may be fined when emergency, police, fire or security personnel are called to respond to a false alarm, so it is desirable to distinguish actual alarm events from false alarm events. Most security systems, on their own, cannot distinguish between a false alarm and an event that would warrant a police or security response.

Aspects of the present invention provide for such distinction by sending notifications of possible alarm events to be displayed and viewed by a user. The user may review information available from home automation systems and determine whether the alarm event is an actual alarm event or a false alarm event. For example, upon reviewing the information from the home automation system, a user may send a signal to a home automation system or home automation gateway to dismiss, ignore or otherwise identify the event as a false alarm event. Alternatively, upon reviewing the information from the home automation system, a user may send a signal to a home automation system or home automation gateway to verify, confirm or otherwise identify the event as an actual alarm event. Such a configuration may advantageously reduce or eliminate false alarm events from inadvertently alerting a security or emergency service. Similarly, such a configuration may advantageously provide more support and confirmation for an actual alarm event and may accordingly result in a quicker emergency or security service response.

Figure 5:
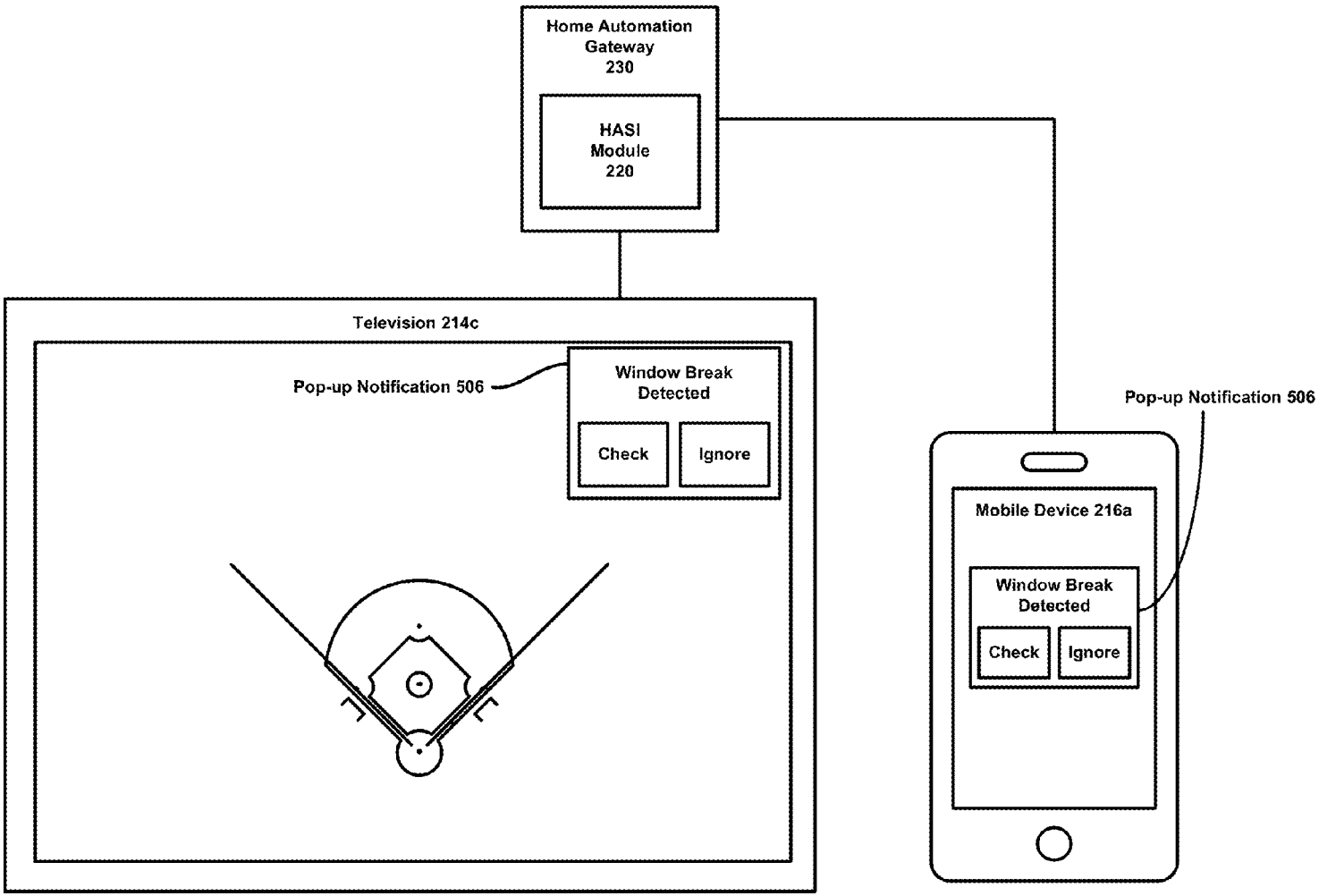
FIG. 5 shows first example aspects of a home automation system.

In one embodiment, home automation information signals are received at home automation gateway 230 from any one or more of the devices and sensors that are part of home automation system 400. Upon detection of a triggering event, such as an event, for example, that would normally trigger an alarm to alert appropriate authorities, signals are communicated to home automation gateway from the sensors or other devices to indicate a possible alarm event was detected. The home automation gateway, in response, may send a notification to a HASI module 220, to generate a display of the notification, such as at a display or presentation device like television 214*a-c* or mobile device 216*a*. Optionally, simultaneous notifications are sent to each presentation device in the system to allow any one or more users to respond to the notification. For example, as depicted in FIG. 5, a pop-up notification 506 on television 214*c* or mobile device 216*a* may be generated to inform the user of the possible alarm event. Other notification and alert techniques are possible. Such a notification may be displayed as part of an on-screen guide by STR 212 or using the built-in notification techniques of a mobile operating system on mobile device 216*a*, for example. For example, a pop-up notification 506 can request input from the user to ignore the notification or to check or review the sensor data to determine if the notification is of an actual alarm event or a false alarm event.

In some embodiments, a timeout period is implemented after which, if no response is detected from a user, an automated call or alert is optionally placed or sent to the emergency or security personnel. In this way, a user can intervene during the timeout period once it is determined that the possible alarm event is a false alarm event, preventing false alarm events from resulting in a call to emergency or security personnel being generated. Alternatively, a default behavior may be set for an event to be identified as a false alarm event unless a confirmatory acknowledgement from a user is received that the alarm event is an actual alarm event.

Dependent upon the notification configuration, a user may optionally respond to the notification by appropriate selection of a prompt to review data from one or more sensors of home automation system 400. For example, if a possible fire alarm event was triggered, temperature sensor data or closed circuit camera video feed data may be communicated to gateway 230 and relayed to the presentation device to allow the user to determine whether the possible alarm event is an actual alarm event or a false alarm event. Similarly, upon detection of a window break, one or more closed circuit camera feeds may be forwarded to the presentation device to allow a user to review the camera feed and determine whether the emergency or security personnel should be notified.

Figure 6:
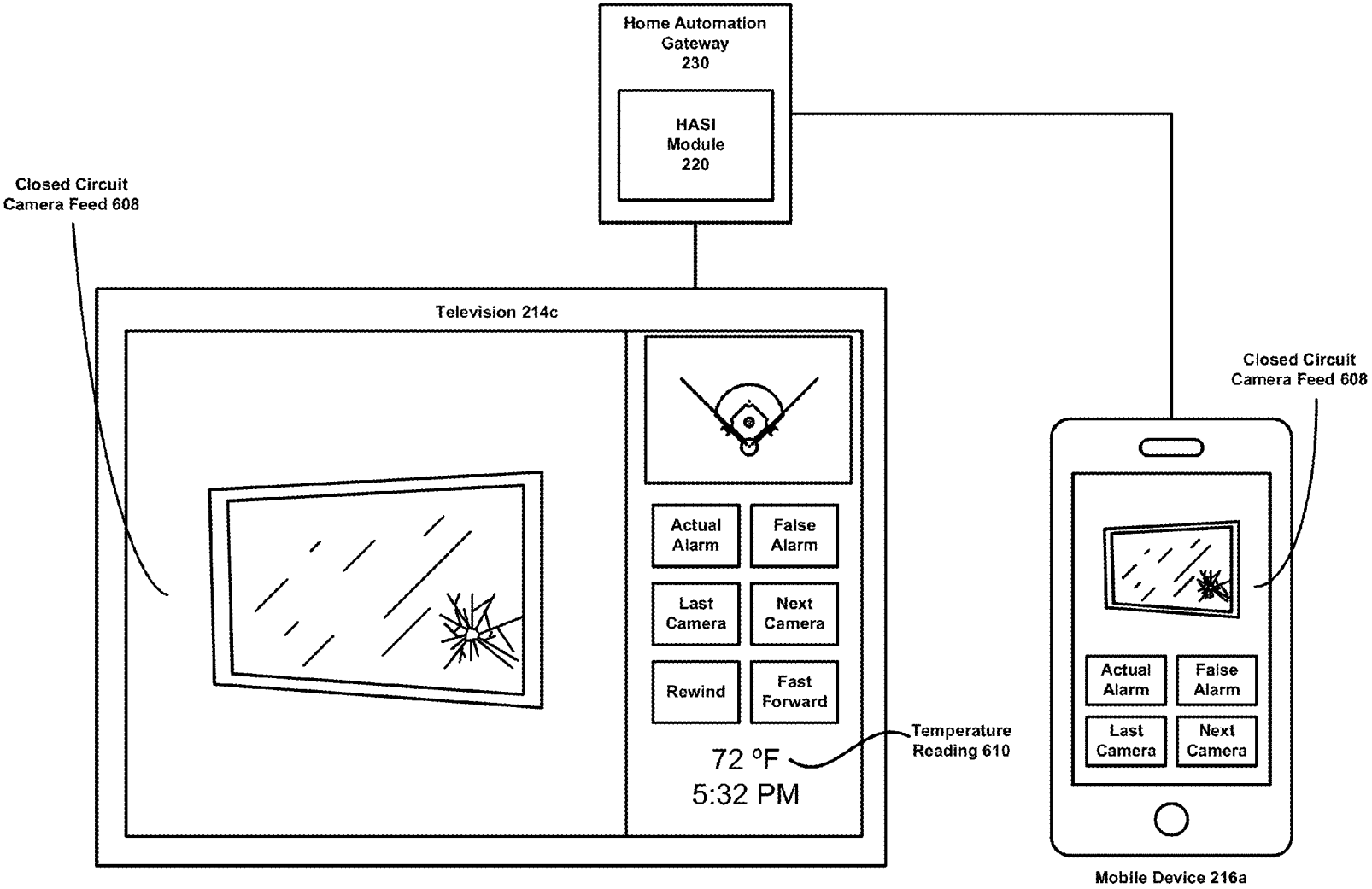
FIG. 6 shows second example aspects of a home automation system.

FIG. 6 illustrates a closed circuit camera feed 608 being displayed on television 214*c* and mobile device 216*a*, depicting a broken window. Optionally, the camera feed may be recorded at gateway 230 to allow a user to review the camera feed during the time period before and/or after the event that triggered the notification, allowing the user to rewind and/or fast forward the video to view, review or search through the video for a relevant activity that may provide insight to the event or to retain relevant evidence of the event. Optionally, a sensor data may be recorded for defined periods of time before and/or after a triggering event. Other information from home automation system 400 may further be included on a display and/or recorded, such as is illustrated on television 214*c* in FIG. 6, which provides a temperature reading 610 from a temperature sensor that is part of home automation system 400.

Upon user selection that a possible alarm event is an actual alarm event or a false alarm event, further user intervention is optionally required to prevent inadvertent selection. For example, FIG. 7 illustrates a further request notification 712 for user input to confirm a prior selection. On television 214*c*, further request notification 712 is shown after a selection of an actual alarm to allow a user to confirm that emergency services should be called or to allow a user to instead specify that the alarm event is a false alarm or to go back to the previous screen to allow further review of sensor data, such as one or more closed circuit security camera feeds. Such a configuration is useful for embodiments where the presentation device includes a telephone or audio transmission implementation, such as a smartphone or a voice over IP system. Similarly, on mobile device 216*a*, further request notification 712 is shown after a selection of a false alarm to allow a user to confirm that no emergency call should be placed because the alarm is a false alarm or to instead indicate that the alarm is an actual alarm. As will be understood by the skilled artisan, the menus, notifications, input types and requests for user input shown in FIG. 5 and FIG. 6 are merely exemplary and should not be construed as limiting, as other menu styles, input requests and notifications may be implemented. Further, user input may be received from any of one or more user input devices, such as a remote control, keyboard, touchscreen display, etc.

Figure 8:
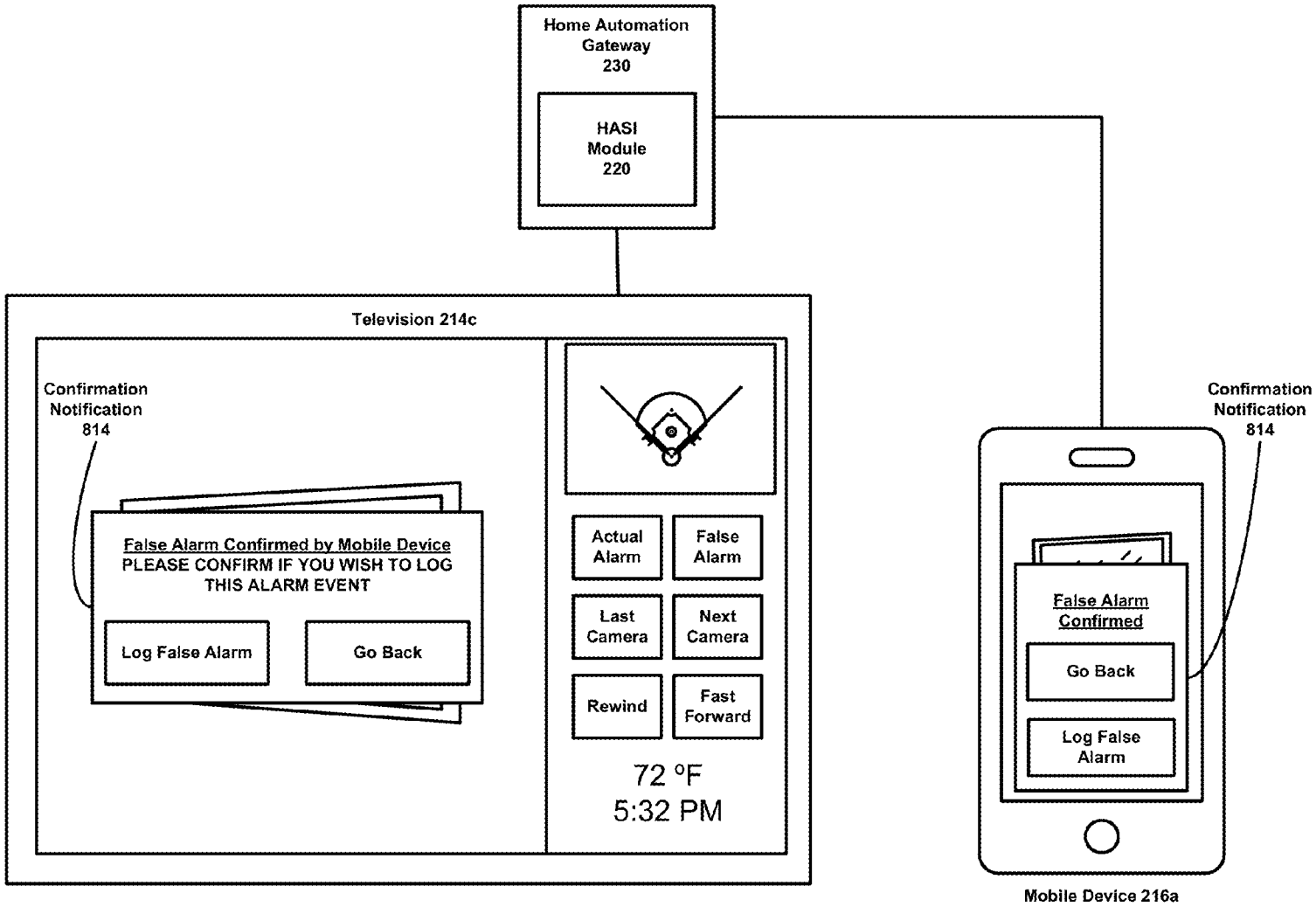
FIG. 8 shows fourth example aspects of a home automation system.

Upon user confirmation of the possible alarm event as an actual alarm event or a false alarm event, in some embodiments, a notification is sent to other display devices in communication with the home automation system to indicate that a user selection has been received. FIG. 8 illustrates such a configuration where the user has sent a confirmation, via mobile device 216*a*, that the alarm event is a false alarm event. In response, mobile device 216*a* may optionally display a confirmation notification 814, showing that the user input was received. Optionally, a request may be displayed for logging the alarm event, such as by recording data received from one or more sensors at home automation gateway 230. Further, television 214*c* may optionally display a confirmation notification 814, showing that user input was received from another device and optionally requesting logging of the alarm event.

Figure 9:
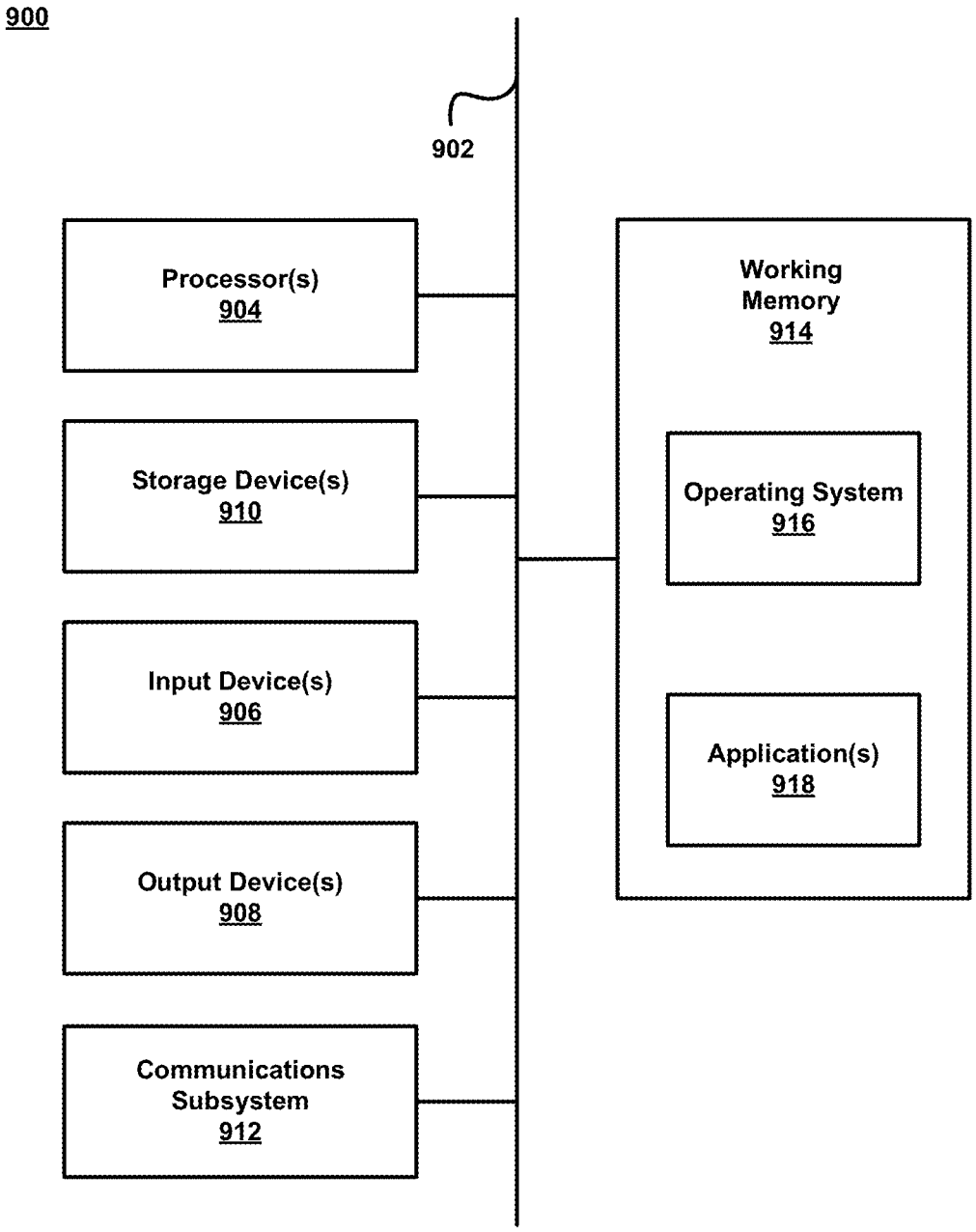
FIG. 9 shows an example computing system or device.

FIG. 9 shows an example computer system or device 900 in accordance with the disclosure. An example of a computer system or device includes a particular "smart" home automation-related sensor or device or system or controller or monitor or detector or the like, an enterprise server, blade server, desktop computer, laptop computer, tablet computer, personal data assistant, smartphone, gaming console, home automation gateway, STB, television receiver, and/or any other type of machine configured for performing calculations. Any particular one of the previously-described computing devices may be wholly or at least partially configured to exhibit features similar to the computer system 900, such as any of the respective elements of at least FIG. 2 and FIG. 4. In this manner, any of one or more of the respective elements of at least FIG. 2 and FIG. 4 may be configured and/or arranged, wholly or at least partially, for enabling an end-user to access home automation features or functionality directly from or via one or more interfaces that might normally be used to access satellite television-related programming and services, in manner consistent with that discussed above in connection with FIGS. 1-8. For example, any of one or more of the respective elements of at least FIG. 2 and/or FIG. 4 may be configured and/or arranged to perform and/or include instructions that, when executed, implement wholly or at least partially the method of FIG. 1. Still further, any of one or more of the respective elements of at least FIG. 2 may be configured to perform and/or include instructions that, when executed, instantiate and implement functionality of the HASI module 220.

The computer device 900 is shown comprising hardware elements that may be electrically coupled via a bus 902 (or may otherwise be in communication, as appropriate). The hardware elements may include a processing unit with one or more processors 904, including without limitation one or more general-purpose processors and/or one or more special-purpose processors (such as digital signal processing chips, graphics acceleration processors, and/or the like); one or more input devices 906, which may include without limitation a remote control, a mouse, a keyboard, and/or the like; and one or more output devices 908, which may include without limitation a presentation device (e.g., television), a printer, and/or the like.

The computer system 900 may further include (and/or be in communication with) one or more non-transitory storage devices 910, which may comprise, without limitation, local and/or network accessible storage, and/or may include, without limitation, a disk drive, a drive array, an optical storage device, a solid-state storage device, such as a random access memory, and/or a read-only memory, which may be programmable, flash-updateable, and/or the like. Such storage devices may be configured to implement any appropriate data stores, including without limitation, various file systems, database structures, and/or the like.

The computer device 900 might also include a communications subsystem 912, which may include without limitation a modem, a network card (wireless and/or wired), an infrared communication device, a wireless communication device and/or a chipset such as a Bluetooth™ device, 902.11 device, WiFi device, WiMax device, cellular communication facilities such as GSM (Global System for Mobile Communications), W-CDMA (Wideband Code Division Multiple Access), LTE (Long Term Evolution), etc., and/or the like. The communications subsystem 912 may permit data to be exchanged with a network (such as the network described below, to name one example), other computer systems, and/or any other devices described herein. In many examples, the computer system 900 will further comprise a working memory 914, which may include a random access memory and/or a read-only memory device, as described above.

The computer device 900 also may comprise software elements, shown as being currently located within the working memory 914, including an operating system 916, device drivers, executable libraries, and/or other code, such as one or more application programs 918, which may comprise computer programs provided by various examples, and/or may be designed to implement methods, and/or configure systems, provided by other examples, as described herein. By way of example, one or more procedures described with respect to the method(s) discussed above, and/or system components might be implemented as code and/or instructions executable by a computer (and/or a processor within a computer); in an aspect, then, such code and/or instructions may be used to configure and/or adapt a general purpose computer (or other device) to perform one or more operations in accordance with the described methods.

A set of these instructions and/or code might be stored on a non-transitory computer-readable storage medium, such as the storage device(s) 910 described above. In some cases, the storage medium might be incorporated within a computer system, such as computer system 900. In other examples, the storage medium might be separate from a computer system (e.g., a removable medium, such as flash memory), and/or provided in an installation package, such that the storage medium may be used to program, configure, and/or adapt a general purpose computer with the instructions/code stored thereon. These instructions might take the form of executable code, which is executable by the computer device 900 and/or might take the form of source and/or installable code, which, upon compilation and/or installation on the computer system 900 (e.g., using any of a variety of generally available compilers, installation programs, compression/decompression utilities, etc.), then takes the form of executable code.

It will be apparent that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some examples may employ a computer system (such as the computer device 900) to perform methods in accordance with various examples of the disclosure. According to a set of examples, some or all of the procedures of such methods are performed by the computer system 900 in response to processor 904 executing one or more sequences of one or more instructions (which might be incorporated into the operating system 916 and/or other code, such as an application program 918) contained in the working memory 914. Such instructions may be read into the working memory 914 from another computer-readable medium, such as one or more of the storage device(s) 910. Merely by way of example, execution of the sequences of instructions contained in the working memory 914 may cause the processor(s) 904 to perform one or more procedures of the methods described herein.

The terms "machine-readable medium" and "computer-readable medium," as used herein, may refer to any non-transitory medium that participates in providing data that causes a machine to operate in a specific fashion. In an embodiment implemented using the computer device 900, various computer-readable media might be involved in providing instructions/code to processor(s) 904 for execution and/or might be used to store and/or carry such instructions/code. In many implementations, a computer-readable medium is a physical and/or tangible storage medium. Such a medium may take the form of a non-volatile media or volatile media. Non-volatile media may include, for example, optical and/or magnetic disks, such as the storage device(s) 910. Volatile media may include, without limitation, dynamic memory, such as the working memory 914.

Example forms of physical and/or tangible computer-readable media may include a floppy disk, a flexible disk, hard disk, magnetic tape, or any other magnetic medium, a compact disc, any other optical medium, ROM (Read Only Memory), RAM (Random Access Memory), and etc., any other memory chip or cartridge, or any other medium from which a computer may read instructions and/or code. Various forms of computer-readable media may be involved in carrying one or more sequences of one or more instructions to the processor(s) 904 for execution. By way of example, the instructions may initially be carried on a magnetic disk and/or optical disc of a remote computer. A remote computer might load the instructions into its dynamic memory and send the instructions as signals over a transmission medium to be received and/or executed by the computer system 900.

The communications subsystem 912 (and/or components thereof) generally will receive signals, and the bus 902 then might carry the signals (and/or the data, instructions, etc., carried by the signals) to the working memory 914, from which the processor(s) 904 retrieves and executes the instructions. The instructions received by the working memory 914 may optionally be stored on a non-transitory storage device 910 either before or after execution by the processor(s) 904. It should further be understood that the components of computer device 900 can be distributed across a network. For example, some processing may be performed in one location using a first processor while other processing may be performed by another processor remote from the first processor. Other components of computer system 900 may be similarly distributed. As such, computer device 900 may be interpreted as a distributed computing system that performs processing in multiple locations. In some instances, computer system 900 may be interpreted as a single computing device, such as a distinct laptop, desktop computer, or the like, depending on the context.

The methods, systems, and devices discussed above are examples. Various configurations may omit, substitute, or add various method steps or procedures, or system components as appropriate. For instance, in alternative configurations, the methods may be performed in an order different from that described, and/or various stages or steps or modules may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those of skill with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations may be performed in parallel or concurrently. In addition, the order of the operations may be rearranged. A process may have additional steps not included in the figure.

Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Furthermore, the example examples described herein may be implemented as logical operations in a computing device in a networked computing system environment. The logical operations may be implemented as: (i) a sequence of computer implemented instructions, steps, or program modules running on a computing device; and (ii) interconnected logic or hardware modules running within a computing device.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method, comprising:

receiving, by a television receiver, a first signal from one or more fire alarm sensors or security alarm sensors indicating a first possible alarm event, wherein the television receiver functions as a home automation gateway connected to a home network;

receiving first sensor data from one or more home automation sensors connected to the home network;

transmitting the first sensor data, wherein receiving the first sensor data at a presentation device generates a first display of the first sensor data;

transmitting a first request for user input to confirm the first possible alarm event;

detecting first user input specifying that the first possible alarm event is a false alarm event;

transmitting a second request for user input to ignore future possible alarm events generated based on additional sensor data sharing one or more characteristics with the first sensor data;

receiving a second signal from the one or more fire alarm sensors or security alarm sensors indicating a second possible alarm event;

receiving second sensor data from the one or more home automation sensors;

transmitting the second sensor data, wherein receiving the second sensor data at the presentation device generates a second display of the second sensor data;

transmitting a third request for user input to confirm the second possible alarm event;

detecting second user input specifying that the second possible alarm event is an actual alarm event.

2. The method of claim 1, further comprising:

facilitating establishing a connection between a user and a local emergency telephone number in response to detecting the second user input.

3. The method of claim 1, wherein the first sensor data and/or the second sensor data includes video or audio from a closed-circuit camera system.

4. The method of claim 3, further comprising:

generating a live video feed acquired by the closed-circuit camera system.

5. The method of claim 3, further comprising:

generating a video feed acquired by the closed-circuit camera system over a predetermined time period before or after the first possible alarm event or before or after the second possible alarm event.

6. The method of claim 1, wherein the first sensor data and/or the second sensor data includes one or more of fire alarm system data and security system data.

7. The method of claim 1, further comprising:

transmitting a notification of the first signal, wherein receiving the notification at the presentation device generates a display of the notification.

8. The method of claim 7, wherein the notification includes the first request for user input.

9. The method of claim 1, wherein receiving sensor data includes receiving sensor data via the home network.

10. A home automation gateway, comprising:

one or more processors;

an audio-video input connection in data communication with the one or more processors;

an audio-video output connection in data communication with the one or more processors;

a network transceiver in data communication with the one or more processors for establishing a network connection with a home network; and a non-transitory computer readable memory element communicatively coupled with and readable by the one or more processors and having stored therein processor-readable instructions that, when executed by the one or more processors, cause the one or more processors to perform operations including:

receiving a first signal from one or more fire alarm sensors or security alarm sensors indicating a first possible alarm event;

receiving first sensor data from one or more home automation sensors connected to the home network;

transmitting the first sensor data, wherein receiving the first sensor data at a presentation device generates a first display of the first sensor data;

transmitting a first request for user input to confirm the first possible alarm event;

detecting first user input specifying that the first possible alarm event is a false alarm event;

transmitting a second request for user input to ignore future possible alarm events generated based on additional sensor data sharing one or more characteristics with the first sensor data;

receiving a second signal from the one or more fire alarm sensors or security alarm sensors indicating a second possible alarm event;

receiving second sensor data from the one or more home automation sensors;

transmitting the second sensor data, wherein receiving the second sensor data at the presentation device generates a second display of the second sensor data transmitting a third request for user input to confirm the second possible alarm event; and detecting second user input specifying that the second possible alarm event is an actual alarm event.

11. The home automation gateway of claim 10, wherein transmitting the first sensor data includes:

overlaying the first sensor data on audio-video signals received at the audio-video input connection to generate an overlaid audio-video feed; and transmitting the overlaid audio-video feed using the audio-video output connection.

12. The home automation gateway of claim 10, wherein the operations further include:

facilitating establishing a connection between a user and a local emergency telephone number in response to detecting the second user input.

13. The home automation gateway of claim 10, wherein the first sensor data and/or the second sensor data includes video or audio from a closed-circuit camera system.

14. The home automation gateway of claim 13, wherein the operations further include:

generating a live video feed acquired by the closed-circuit camera system.

15. The home automation gateway of claim 13, wherein the operations further include:

generating a video feed acquired by the closed-circuit camera system over a predetermined time period before or after the first possible alarm event or before or after the second possible alarm event.

16. The home automation gateway of claim 10, wherein the first sensor data and/or the second sensor data includes one or more of fire alarm system data and security system data.

17. The home automation gateway of claim 10, wherein the operations further include:

transmitting a notification of the first signal, wherein receiving the notification at the presentation device generates a display of the notification.

18. The home automation gateway of claim 17, wherein the notification includes the first request for user input.

19. The home automation gateway of claim 10, wherein receiving the first sensor data includes receiving the first sensor data via the home network.

20. A non-transitory computer readable medium comprising instructions that, when executed by one or more processors, cause the one or more processors to perform operations including:

receiving a first signal from one or more fire alarm sensors or security alarm sensors indicating a first possible alarm event;

receiving first sensor data from one or more home automation sensors connected to a home network;

transmitting the first sensor data, wherein receiving the first sensor data at a presentation device generates a first display of the first sensor data;

transmitting a first request for user input to confirm the first possible alarm event;

detecting first user input specifying that the first possible alarm event is a false alarm event;

transmitting a second request for user input to ignore future possible alarm events generated based on additional sensor data sharing one or more characteristics with the first sensor data;

receiving a second signal from the one or more fire alarm sensors or security alarm sensors indicating a second possible alarm event;

receiving second sensor data from the one or more home automation sensors;

transmitting the second sensor data, wherein receiving the second sensor data at the presentation device generates a second display of the second sensor data;

transmitting a third request for user input to confirm the second possible alarm event; and detecting second user input specifying that the second possible alarm event is an actual alarm event.

* * * * *